US011879708B1

(12) United States Patent
Brush et al.

(10) Patent No.: US 11,879,708 B1
(45) Date of Patent: Jan. 23, 2024

(54) DEMOLITION CONTAINER

(71) Applicant: Point One USA, LLC, Virginia Beach, VA (US)

(72) Inventors: Robert E. Brush, Virginia Beach, VA (US); Cameron M. Hovenga, Virginia Beach, VA (US)

(73) Assignee: Point One USA, LLC, Virginia Beach, VA (US)

( * ) Notice: Subject to any disclaimer, the term of this patent is extended or adjusted under 35 U.S.C. 154(b) by 208 days.

(21) Appl. No.: 17/337,927

(22) Filed: Jun. 3, 2021

(51) Int. Cl.

| | |
|---|---|
| ***F42B 1/028*** | (2006.01) |
| ***F42B 3/02*** | (2006.01) |
| ***F42B 3/08*** | (2006.01) |
| ***F42B 33/00*** | (2006.01) |
| ***F42D 3/02*** | (2006.01) |
| ***F42D 1/02*** | (2006.01) |

(52) U.S. Cl.
CPC ..... *F42B 1/028* (2013.01); *F42B 3/02* (2013.01); *F42B 3/08* (2013.01); *F42B 33/001* (2013.01); *F42D 1/02* (2013.01); *F42D 3/02* (2013.01)

(58) Field of Classification Search
CPC .... F42B 1/00; F42B 1/02; F42B 1/028; F42B 1/036; F42B 3/00; F42B 3/02; F42B 3/08; F42B 33/00; F42B 33/001; F42D 1/00; F42D 1/02; F42D 3/00; F42D 3/02; F42D 3/04; F42D 3/06
USPC ..... 102/306–310, 331, 475, 476
See application file for complete search history.

(56) References Cited

U.S. PATENT DOCUMENTS

| | | | | |
|---|---|---|---|---|
| 3,019,731 | A * | 2/1962 | Edwin | E21B 43/117 102/310 |
| 3,670,828 | A * | 6/1972 | Bennett | F42B 3/08 175/4.6 |
| 3,695,141 | A | 10/1972 | Kronman et al. | |
| 4,387,773 | A * | 6/1983 | McPhee | F42B 3/08 102/306 |
| 4,481,886 | A * | 11/1984 | Brattstrom | F42B 1/028 102/306 |
| H866 | H * | 1/1991 | Faccini | 102/307 |
| 4,982,665 | A * | 1/1991 | Sewell | F42B 1/02 102/306 |
| 5,814,758 | A | 9/1998 | Eidel | |
| 7,299,735 | B2 | 11/2007 | Alford | |
| 9,441,924 | B1 * | 9/2016 | Frericks | F42B 1/028 |
| 9,534,874 | B2 * | 1/2017 | Alford | F42B 1/028 |

(Continued)

*Primary Examiner* — James S Bergin
(74) *Attorney, Agent, or Firm* — Shaddock Law Group, PC

(57) ABSTRACT

A demolition container including a demolition container having a demolition container aperture formed therethrough and defining a demolition container aperture shoulder, wherein a demolition liner is insertable into the demolition container aperture and interaction between the demolition liner and the demolition container aperture shoulder maintains the demolition liner in an appropriate position within the demolition container aperture; and a demolition container cap having an extending cap coupling portion extending from a portion of a cap portion, wherein demolition container cap aperture is formed through the demolition container cap, and wherein the demolition container and the demolition container cap may optionally be attached or coupled to one another, via interaction of the recessed coupling portion of the demolition container and the extending cap coupling portion of the demolition container cap.

20 Claims, 17 Drawing Sheets

(56) References Cited

U.S. PATENT DOCUMENTS

| | | | | |
|---|---|---|---|---|
| 10,683,735 | B1 * | 6/2020 | McCarthy | F42B 1/028 |
| 10,969,204 | B2 * | 4/2021 | Sivley | F42B 3/00 |
| 11,650,031 | B2 * | 5/2023 | Galloway | F42B 1/036<br>102/307 |
| 2010/0043661 | A1 * | 2/2010 | Graham | F42B 1/028<br>102/307 |
| 2018/0283831 | A1 * | 10/2018 | Ryu | F42B 1/028 |

* cited by examiner

DEMOLITION CONTAINER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of explosive devices and systems. More specifically, the present disclosure relates to a demolition container.

2. Description of Related Art

In the realm of Explosive Ordnance Disposal (EOD) operations, it is often required to perform an explosive work function with the resources at hand. The industry is usually limited to commercially packed charges that are not necessarily correct for the task at hand.

An explosively formed penetrator (EFP) utilizes an explosive charge to deform a metal plate into a slug or rod shape and accelerate it toward a target. Typically, an EFP has a liner face in the shape of a shallow dish. The force of the explosive molds the liner into a desired shape, depending on the shape of the plate and how the explosive is detonated.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

Unfortunately, known tools and techniques have a number of shortcomings. For example, in known systems using drive flyer plates and shape charges, explosives are packed into a container, and then a liner is inserted. In these cases, pockets of air are trapped between the liner and the explosives, which can and do alter the liner's desired effects. Other commercially prepacked charges are purpose-built and have a shelf life, performance issues for the end-user, and transportation and shipping concerns. Purpose-built liners do not always provide the desired effect for the end-user.

In order to overcome these and other shortcomings of known EFP tools and systems, the demolition container of the present disclosure provides a demolition container designed for a variety of demolition work functions within, for example, EOD operations, basic and advanced demolition operations, and the mining industry. This demolition container utilizes purpose-built components and demolition liners in a hand packable container that, once assembled, can perform a wide variety of explosive work functions. The broad spectrum of the capability of this system has application throughout the explosives industry.

The demolition container of the present disclosure relates to a hand packable system with plastic C4 type explosives and a selectable demolition liner that can be utilized to do a variety of explosive work functions. This demolition container system provides a selectable option to pick the tool required to accomplish a specific objective. This demolition container may optionally be used with bulk explosives only or may incorporate a hemispherical, conical, linear, or metal disk to destroy, disassemble, cut, or uncap military ordnance, steel construction material, buried items, etc.

The demolition container of the present disclosure allows the end-user to select the demolition liner and packs the charge in reverse, which equates to the explosives being packed in the container's body onto the demolition liner. This dramatically improves efficiency and work productivity. The demolition container system has no shelf life or shipping concerns as the end-user builds the charge with their explosives. Because the system is hand-packed, the end-user can build the charge to meet specific requirements as desired. The demolition container of the present disclosure is designed to improve the explosives industry capability by offering a hand packable system with a wide variety of options.

This demolition container system offers the opportunity to choose the required capability needed to accomplish a given task. The demolition liners' speeds being projected from the system can reach 20,000 fps with a density that is sufficient to cut into ½ inch to 2 inches of steel, depending on the demolition liner selected. The demolition container system improves the explosive industry with a hand packable option that allows a user to decide which option is best for a given task.

In certain exemplary, nonlimiting embodiments, the demolition container system of the present disclosure provides at least some of a demolition container extending from a demolition container first end to a demolition container second end and having an exterior surface, wherein a demolition container aperture, defined by one or more side walls, is formed through the demolition container, extending from a first demolition container aperture open end formed in the demolition container first end to a second demolition container aperture open end formed in the demolition container second end, wherein the demolition container aperture has a first inner diameter as the demolition container aperture extends from the first demolition container aperture open end, toward the demolition container second end, to a demolition container aperture shoulder, wherein the demolition container aperture has a second inner diameter as the demolition container aperture extends from the demolition container aperture shoulder to the demolition container second end, wherein an extending coupling portion is formed proximate or within a portion of the demolition container second end and a recessed coupling portion is formed proximate or within a portion of the demolition container first end, wherein the extending coupling portion extends from a coupling portion surface to the demolition container second end, wherein one or more coupling tabs extend, at spaced apart locations, from the extending coupling portion, and wherein a coupling tab shoulder is formed between a surface of each coupling tab and the extending coupling portion, wherein the recessed coupling portion is formed between a recess portion surface formed within the demolition container aperture and the demolition container first end, wherein the recessed coupling portion includes one or more recess locking tabs, wherein each recess locking tab extends from a sidewall of the recessed coupling portion, proximate the demolition container first end, and towards a middle of the demolition container aperture, and wherein a coupling slot is defined between each of the recess locking tabs, and wherein a plurality of recessed channels are formed in the interior side walls, extending from the demolition container second end to the recess portion surface; a demolition container cap, wherein the demolition container cap includes a cap portion having a cap portion surface, wherein an extending cap coupling portion extends from a portion of the cap portion surface, wherein one or more cap coupling tabs extend from the extending cap coupling portion at spaced apart locations, wherein a cap coupling tab shoulder is formed between a surface of each cap coupling tab and the extending cap coupling portion, wherein at least one demolition container cap aperture is formed through the demolition container cap, wherein the demolition container cap aperture includes internal cap aperture threads, and wherein the demolition container and the demolition container cap may optionally be attached or coupled to one another, via interaction of the recessed coupling portion of the demolition container and the extending cap coupling portion of the demolition container cap; a strain relief connector having a strain relief connector body portion, wherein external strain relief connector body threads are formed in at least a portion of the strain relief connector body portion, said strain relief connector body portion being at least partially insertable through said demolition container cap aperture such that at least a portion of said external strain relief connector body threads extend through said demolition container cap aperture, said external strain relief connector body threads formed so as to interact with cap aperture threads to repeatably threadedly attached said strain relief connector to said demolition container cap; and at least one demolition liner, wherein the at least one demolition liner is insertable into the first demolition container aperture open end and urged into the demolition container aperture such that at least a portion of the at least one demolition liner contacts the demolition container aperture shoulder and interaction between at least a portion of the at least one demolition liner and a portion of the demolition container aperture shoulder maintains the at least one demolition liner in an appropriate position within the demolition container aperture and a demolition container cavity is formed between the at least one demolition liner and at least the recess portion surface of the recessed coupling portion.

In certain exemplary, nonlimiting embodiments, the demolition container includes a longitudinal axis extending from the demolition container first end to the demolition container second end.

In certain exemplary, nonlimiting embodiments, the exterior surface of the demolition container has a substantially triangular cross-sectional shape.

In certain exemplary, nonlimiting embodiments, the side walls are formed of a single, continuous, integrally formed wall portion.

In certain exemplary, nonlimiting embodiments, the side walls are formed of multiple coupled or joined wall portions.

In certain exemplary, nonlimiting embodiments, the demolition container aperture has a substantially cylindrical overall cross-sectional shape.

In certain exemplary, nonlimiting embodiments, the second, inner diameter of the demolition container aperture is smaller than the first, inner diameter of the demolition container aperture.

In certain exemplary, nonlimiting embodiments, at least one of the recess locking tabs includes a recess stop proximate an end of the recess locking tab extending between the recess portion shoulder and the recess portion surface of the recessed coupling portion.

In certain exemplary, nonlimiting embodiments, a number of coupling tabs of the extending coupling portion corresponds to a number of coupling slots of the recessed coupling portion.

In certain exemplary, nonlimiting embodiments, the recessed channels are formed in spaced apart pairs.

In certain exemplary, nonlimiting embodiments, a first demolition container and a second demolition container may be attached or coupled together, via interaction of the recessed coupling portion of the first demolition container and the extending coupling portion of the second demolition container.

In certain exemplary, nonlimiting embodiments, the extending cap coupling portion comprises a protrusion configured to fit within at least a portion of the recessed coupling portion.

In certain exemplary, nonlimiting embodiments, a number of cap coupling tabs of the extending cap coupling portion corresponds to or is less than a number of coupling slots of the recessed coupling portion of the demolition container.

In certain exemplary, nonlimiting embodiments, the recess portion shoulder of each of the recess locking tabs is separated from the recess portion surface by a space allowing the cap coupling tabs of the extending cap coupling portion to be rotatable within the recess of the recessed coupling portion.

In certain exemplary, nonlimiting embodiments, during attachment or coupling of the demolition container cap and the demolition container, the cap coupling tabs of the extending cap coupling portion are initially aligned with the coupling slots of the recessed coupling portion, the cap coupling tabs are urged through the respective coupling slots and the cap coupling tabs of the extending cap coupling portion of the demolition container cap are positioned within at least a portion of the recessed coupling portion of the demolition container, the demolition container cap is rotated, such that the cap coupling tabs of the extending cap coupling portion are positioned under at least a portion of the recess locking tabs of the recessed coupling portion.

In certain exemplary, nonlimiting embodiments, the demolition liner is a conical demolition liner, a linear demolition liner, a hemispherical demolition liner, or an Explosively Formed Projectile demolition liner.

In certain exemplary, nonlimiting embodiments, the demolition container system of the present disclosure provides at least some of a demolition container extending from a demolition container first end to a demolition container second end, wherein a demolition container aperture is formed through the demolition container, extending from the demolition container first end to the demolition container second end, wherein the demolition container aperture has a first inner diameter as the demolition container aperture extends from the demolition container first end, toward the demolition container second end, to a demolition container aperture shoulder, wherein the demolition container aperture has a second inner diameter as the demolition container aperture extends from the demolition container aperture shoulder to the demolition container second end, wherein an extending coupling portion is formed proximate or within a portion of the demolition container second end and a recessed coupling portion is formed proximate or within a portion of the demolition container first end; a demolition container cap, wherein the demolition container cap includes a cap portion having a cap portion surface, wherein an extending cap coupling portion extends from a portion of the cap portion surface, wherein at least one demolition container cap aperture is formed through the demolition container cap, wherein the demolition container cap aperture includes internal cap aperture threads, and wherein the demolition container and the demolition container cap may optionally be attached or coupled to one another, via interaction of the recessed coupling portion of the demolition container and the extending cap coupling portion of the demolition container cap; and at least one demolition liner, wherein the at least one demolition liner is insertable into the demolition container aperture such that at least a portion of the at least one demolition liner contacts the demolition container aperture shoulder and interaction between at least a portion of the at least one demolition liner and a portion of the demolition container aperture shoulder maintains the at least one demolition liner in an appropriate position within the demolition container aperture and a demolition container cavity is formed between the at least one demolition liner and at least the recess portion surface of the recessed coupling portion.

In certain exemplary, nonlimiting embodiments, the demolition container aperture is defined by one or more side walls and wherein a plurality of recessed channels are formed in the interior side walls, extending from the demolition container second end to the recess portion surface.

In certain exemplary, nonlimiting embodiments, the demolition container system of the present disclosure provides at least some of a demolition container extending from a demolition container first end to a demolition container second end, wherein a demolition container aperture is formed through the demolition container, wherein the demolition container aperture extends from the demolition container first end, toward the demolition container second end, to a demolition container aperture shoulder, wherein the demolition container aperture extends from the demolition container aperture shoulder to the demolition container second end, wherein an extending coupling portion is formed proximate or within a portion of the demolition container second end and a recessed coupling portion is formed proximate or within a portion of the demolition container first end, wherein at least one demolition liner is insertable into the demolition container aperture such that at least a portion of the at least one demolition liner contacts the demolition container aperture shoulder and interaction between at least a portion of the at least one demolition liner and a portion of the demolition container aperture shoulder maintains the at least one demolition liner in an appropriate position within the demolition container aperture and a demolition container cavity is formed between the at least one demolition liner and at least the recess portion surface of the recessed coupling portion; a demolition container cap, wherein the demolition container cap includes a cap portion and an extending cap coupling portion extending from a portion of the cap portion, wherein at least one demolition container cap aperture is formed through the demolition container cap, and wherein the demolition container and the demolition container cap may optionally be attached or coupled to one another, via interaction of the recessed coupling portion of the demolition container and the extending cap coupling portion of the demolition container cap.

In certain exemplary, nonlimiting embodiments, the demolition container aperture is defined by one or more side walls and wherein a plurality of recessed channels are formed in the interior side walls, extending from the demolition container second end to the recess portion surface.

In certain exemplary, nonlimiting embodiments, the demolition container system of the present disclosure provides at least some of a demolition container having a demolition container aperture formed therethrough and defining a demolition container aperture shoulder, wherein a demolition liner is insertable into the demolition container aperture and interaction between the demolition liner and the demolition container aperture shoulder maintains the demolition liner in an appropriate position within the demolition container aperture; and a demolition container cap having an extending cap coupling portion extending from a portion of a cap portion, wherein demolition container cap aperture is formed through the demolition container cap, and wherein the demolition container and the demolition container cap may optionally be attached or coupled to one another, via interaction of the recessed coupling portion of the demolition container and the extending cap coupling portion of the demolition container cap.

Accordingly, the present disclosure separately and optionally provides a demolition container that may be customized with a variety of demolition liners.

The present disclosure separately and optionally provides an expedient demolition container system that provides a variety of customization options when demolition work functions are required.

The present disclosure separately and optionally provides an expedient demolition container system that, when built with a desired demolition liner, will provide the correct explosive charge for a particular task.

The present disclosure separately and optionally provides an expedient demolition container system that is capable of propelling a metal shaped demolition liner in a manner where a sufficient amount of material and energy enters the target and breaks it apart, detonates it, or cuts the material and achieves the desired work effect.

The present disclosure separately and optionally provides a demolition container with increased detonation reliability.

The present disclosure separately and optionally provides a demolition container that can be quickly and easily deployed.

The present disclosure separately and optionally provides a demolition container that can be armed and deployed using a simplified explosive packing technique.

The present disclosure separately and optionally provides a demolition container that provides a standoff distance for deployment.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein.

In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
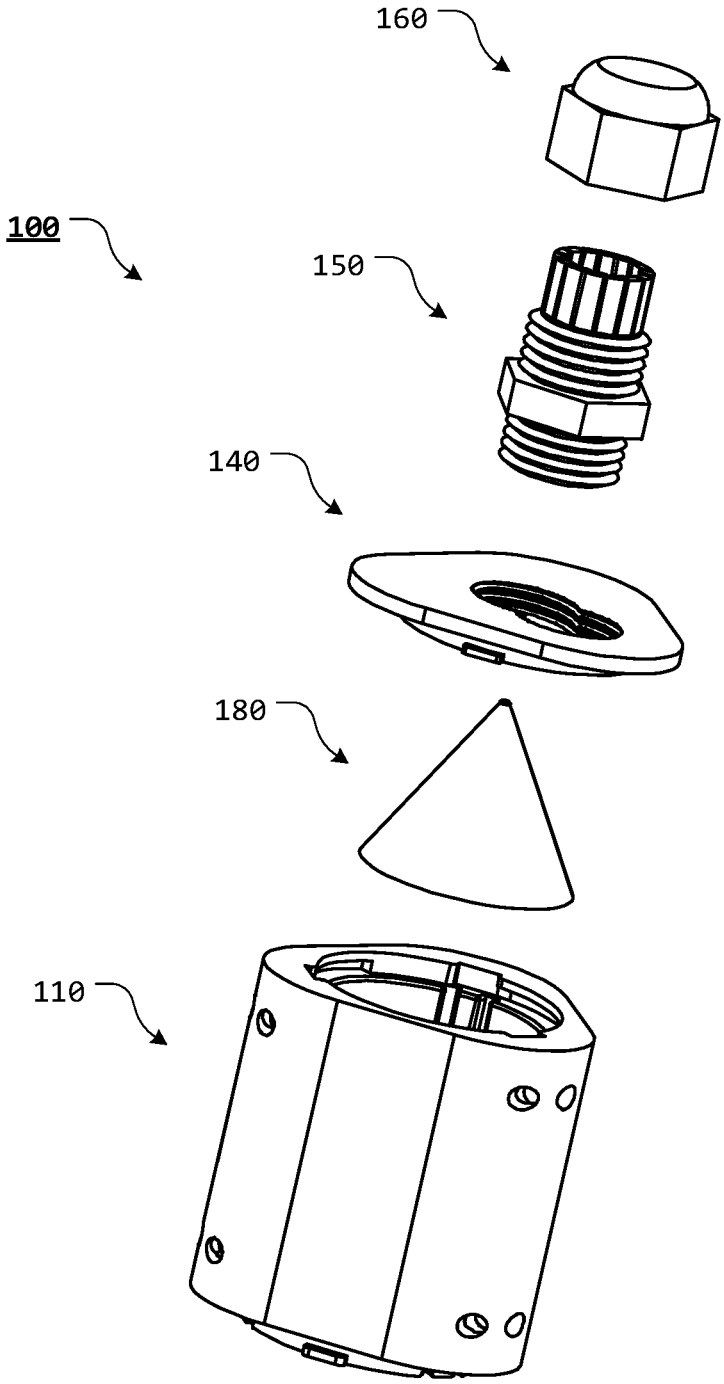
FIG. 1 illustrates an exploded, upper, perspective view of certain exemplary components of an exemplary embodiment of a demolition container system assembly, according to the present disclosure.
Figure 2:
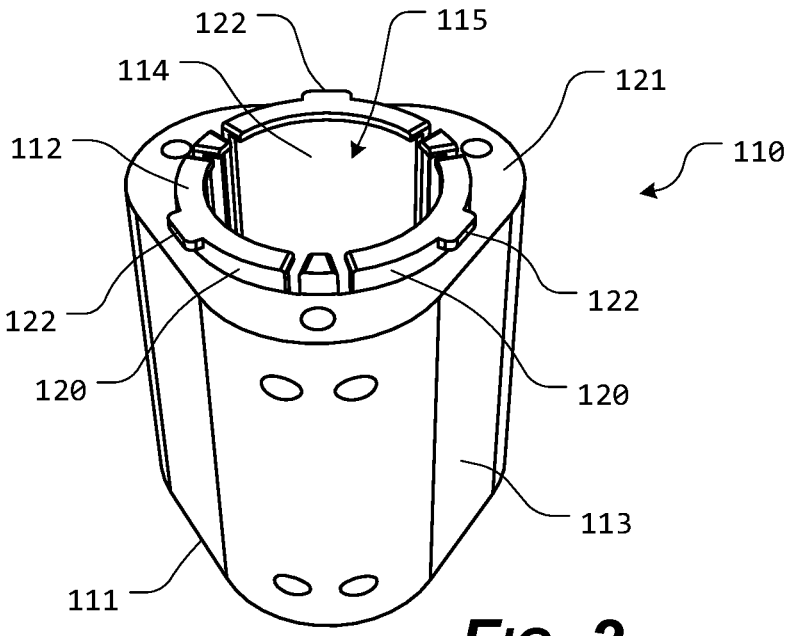
FIG. 2 illustrates an upper, perspective, view of certain exemplary components of an exemplary embodiment of A demolition container system, according to the present disclosure.
Figure 3:
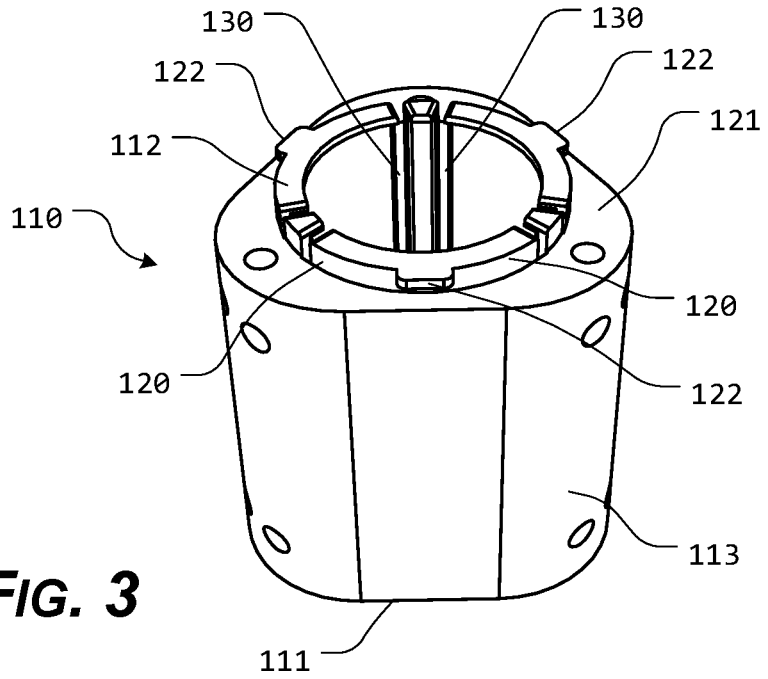
FIG. 3 illustrates an upper, perspective, view of certain exemplary components of an exemplary embodiment of A demolition container system, according to the present disclosure.
Figure 4:
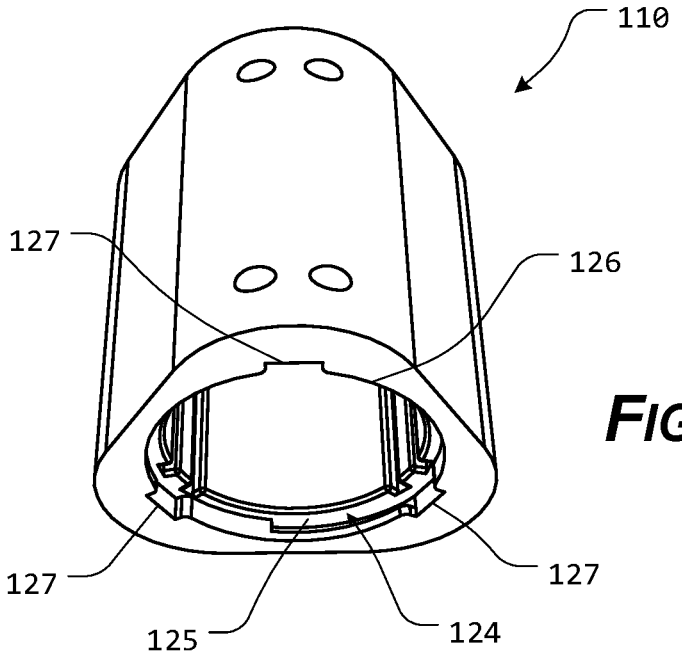
FIG. 4 illustrates a lower, perspective, view of certain exemplary components of an exemplary embodiment of A demolition container system, according to the present disclosure.
Figure 5:
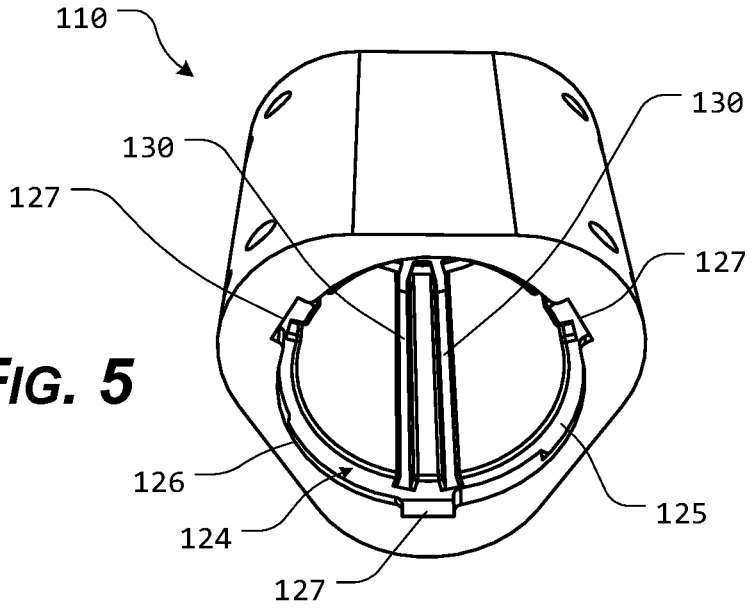
FIG. 5 illustrates a lower, perspective, view of certain exemplary components of an exemplary embodiment of A demolition container system, according to the present disclosure.
Figure 6:
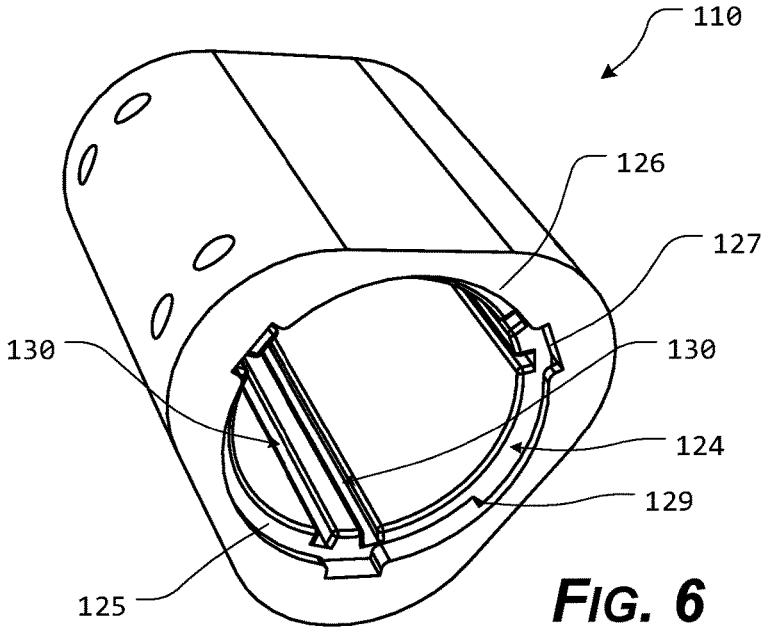
FIG. 6 illustrates a lower, perspective, view of certain exemplary components of an exemplary embodiment of A demolition container system, according to the present disclosure.
Figure 7:
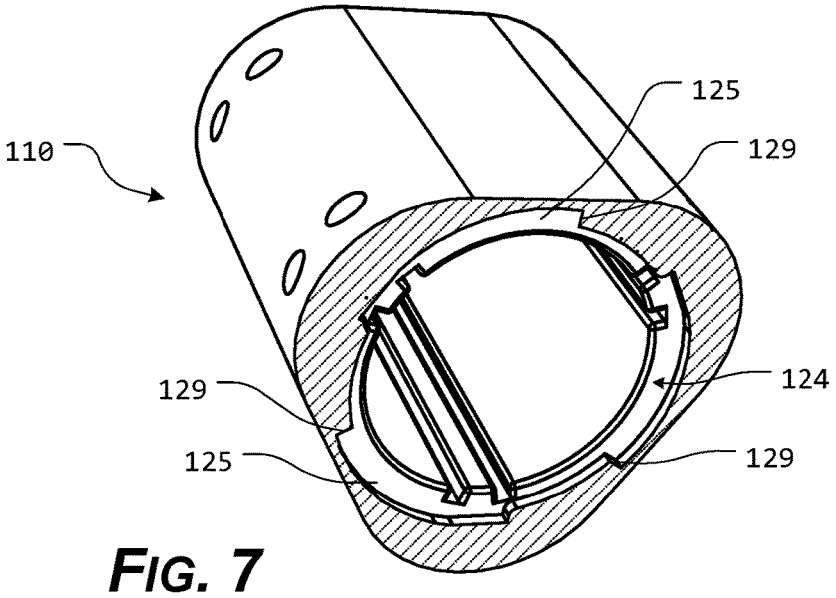
FIG. 7 illustrates a lower, perspective, cross-sectional view of certain exemplary components of an exemplary embodiment of A demolition container system, according to the present disclosure.
Figure 8:
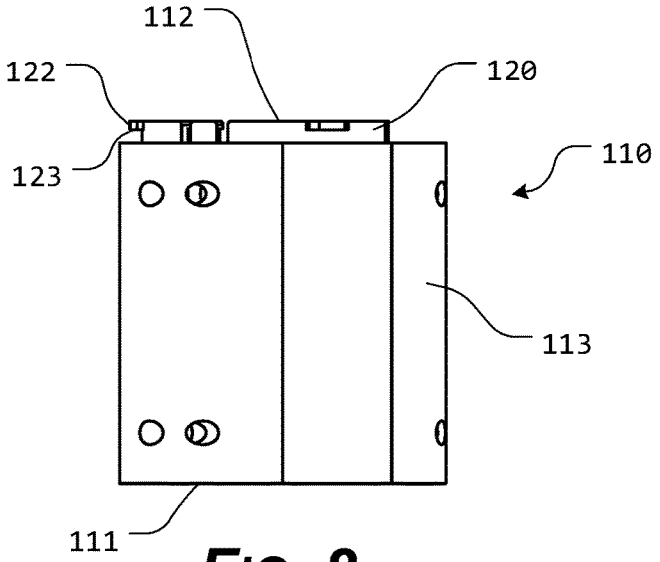
FIG. 8 illustrates a side view of certain exemplary components of an exemplary embodiment of A demolition container system, according to the present disclosure.
Figure 9:
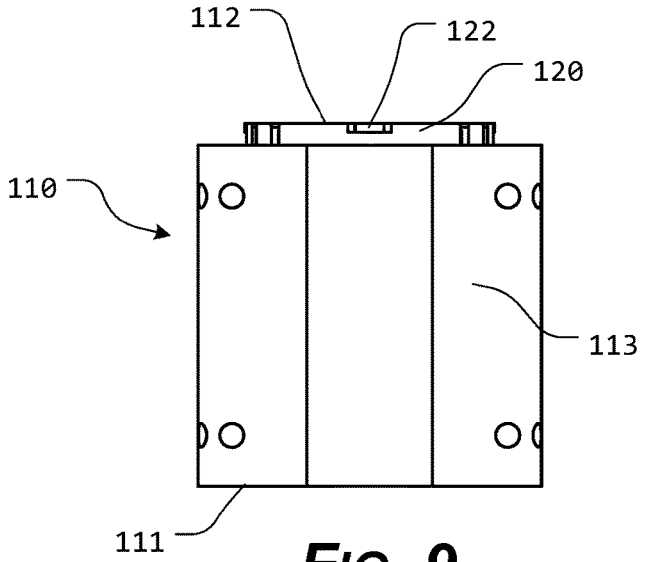
FIG. 9 illustrates a front view of certain exemplary components of an exemplary embodiment of A demolition container system, according to the present disclosure.
Figure 10:
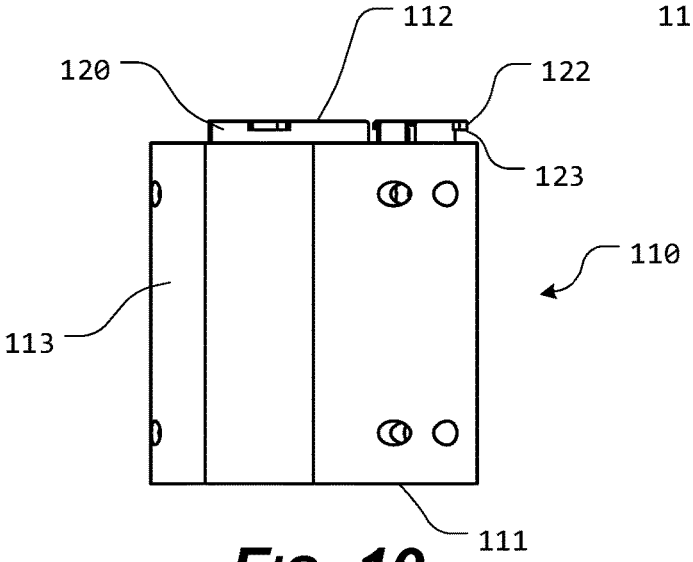
FIG. 10 illustrates a side view of certain exemplary components of an exemplary embodiment of A demolition container system, according to the present disclosure.
Figure 11:
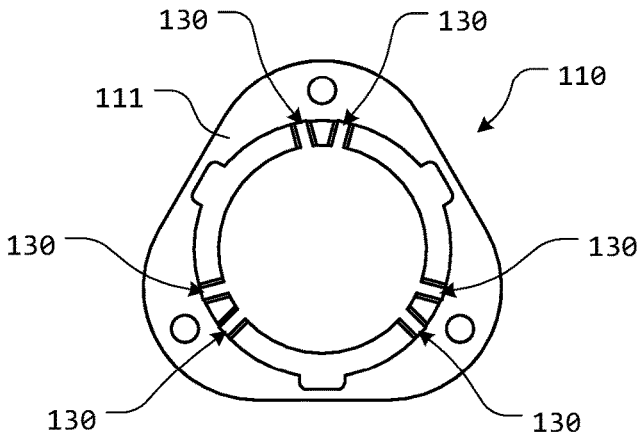
FIG. 11 illustrates a top view of certain exemplary components of an exemplary embodiment of A demolition container system, according to the present disclosure.
Figure 12:
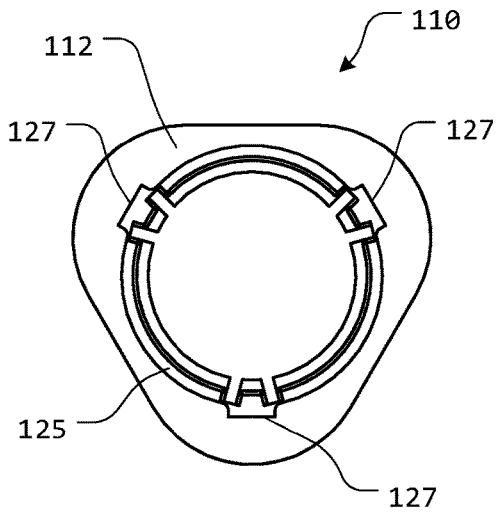
FIG. 12 illustrates a bottom view of certain exemplary components of an exemplary embodiment of A demolition container system, according to the present disclosure.
Figure 13:
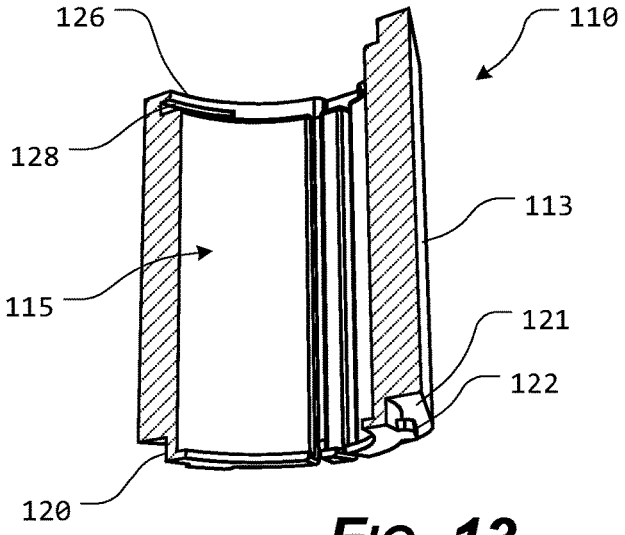
FIG. 13 illustrates a lower, perspective, cross-sectional view of certain exemplary components of an exemplary embodiment of A demolition container system, according to the present disclosure.
Figure 14:
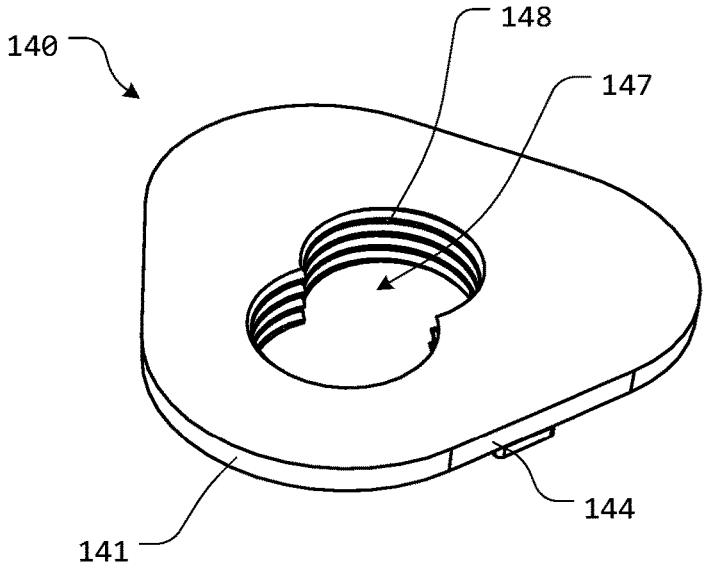
FIG. 14 illustrates an upper perspective view of certain exemplary components of an exemplary embodiment of a demolition container cap, according to the present disclosure.
Figure 15:
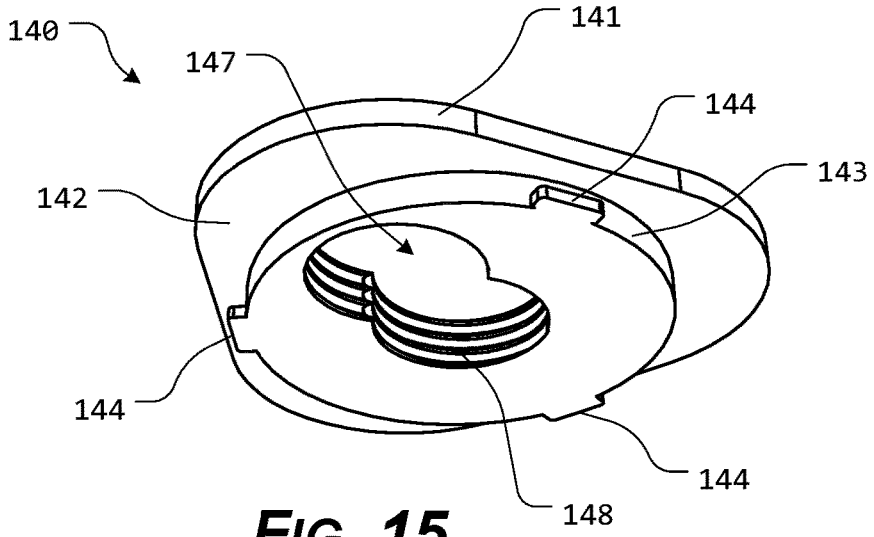
FIG. 15 illustrates a lower perspective view of certain exemplary components of an exemplary embodiment of a demolition container cap, according to the present disclosure.
Figure 16:
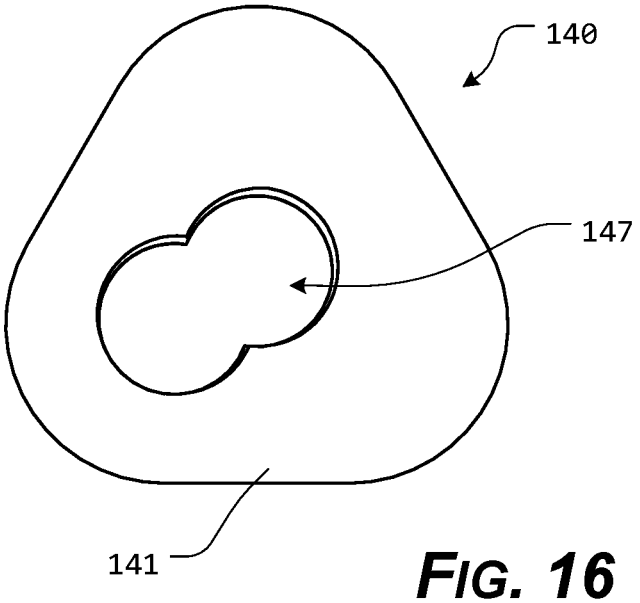
FIG. 16 illustrates a top view of certain exemplary components of an exemplary embodiment of a demolition container cap, according to the present disclosure.
Figure 17:
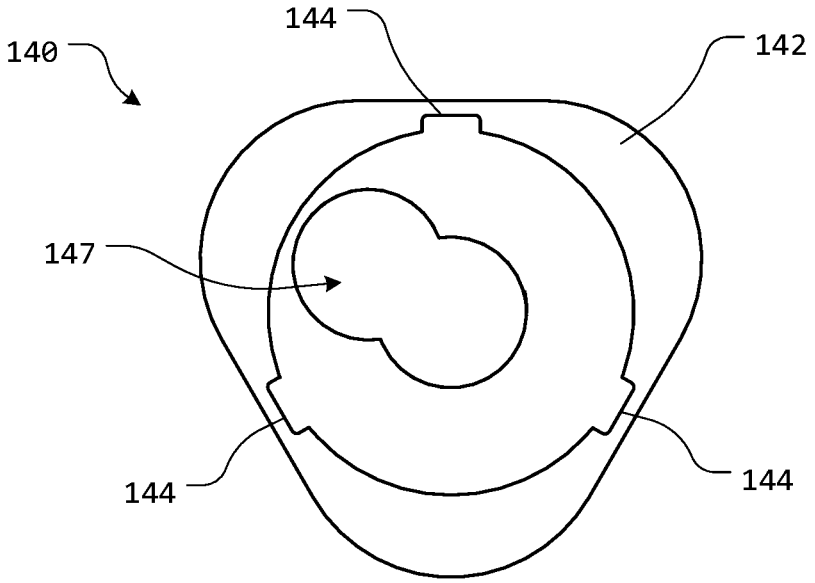
FIG. 17 illustrates a bottom view of certain exemplary components of an exemplary embodiment of a demolition container cap, according to the present disclosure.
Figure 18:
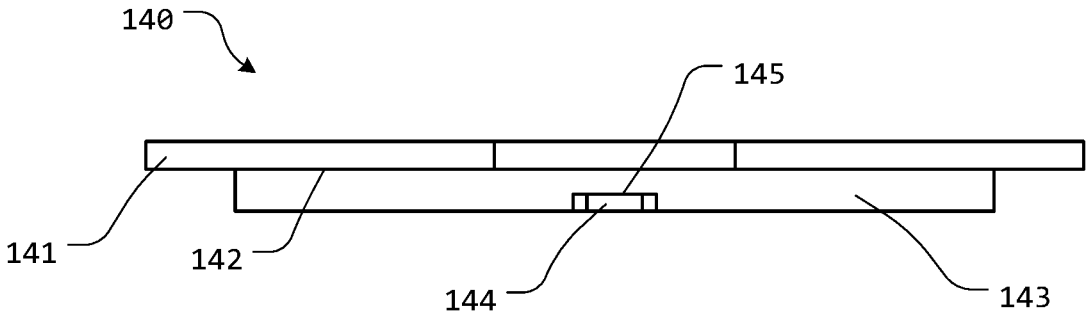
FIG. 18 illustrates a front view of certain exemplary components of an exemplary embodiment of a demolition container cap, according to the present disclosure.
Figure 19:
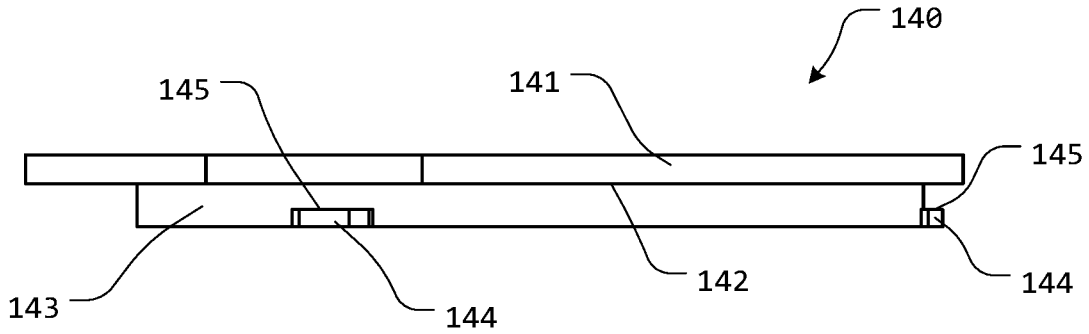
FIG. 19 illustrates a side view of certain exemplary components of an exemplary embodiment of a demolition container cap, according to the present disclosure.

For simplicity and clarification, the design factors and operating principles of the demolition container according to the present disclosure are explained with reference to various exemplary embodiments of a demolition container according to the present disclosure. The basic explanation of the design factors and operating principles of the demolition container is applicable for the understanding, design, and operation of the demolition container of the present disclosure. It should be appreciated that the demolition container can be adapted to many applications where a demolition container can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed demolition container may optionally be used in a "mirror image" assembly, wherein elements shown and/or described as being included in or on an upper or identified side portion may optionally be included in or on a lower or other side portion. Alternatively, certain of the elements that are shown and/or described as being included in or on a back portion may optionally be included in or on a front portion, or vice versa.

It should also be appreciated that the terms "demolition container" and "demolition liner" are used for basic explanation and understanding of the operation of the systems, methods, and apparatuses of the present disclosure. Therefore, the terms "demolition container" and "demolition liner" are not to be construed as limiting the systems, methods, and apparatuses of the present disclosure.

Furthermore, it should be appreciated that, for simplicity and clarification, the embodiments of the present disclosure will be shown and/or described with reference to the demolition container being utilized in connection with certain demolition liners. However, it should be appreciated that the demolition container of the present disclosure may be utilized in connection various demolition liners.

Turning now to the appended drawing figures, FIGS. 1-37 illustrate certain elements, components, and/or aspects of certain exemplary embodiments of a demolition container system 100 and/or a demolition container 110, according to the present disclosure.

As illustrated most clearly in FIGS. 1-24, the demolition container system 100 comprises at least some of a demolition container 110, a demolition liner (such as, for example, a conical demolition liner 180, a linear demolition liner 285, a hemispherical demolition liner 380, or an EFP demolition liner 480), a demolition container cap 140, a strain relief connector 150, and a connector nut 160.

In various exemplary embodiments, the demolition container 110 includes an exterior surface 113 and includes a longitudinal axis, $A_L$, that extends generally from a demolition container first end 111 to a demolition container second end 112.

The exterior surface 113 the demolition container 110 may optionally substantially triangular cross-section, when viewed from the demolition container first end 111 to a demolition container second end 112, substantially perpendicular to the longitudinal axis, $A_L$, of the demolition container 110. In this manner at least a portion of the exterior surface 113 easily be positioned against are aligned with a substantially planar surface. It should also be appreciated that the exterior surface 113 of the demolition container 110 is not so limited. Thus, in certain alternative embodiments, the exterior surface 113 of the demolition container 110 may have an overall cross-sectional shape that is substantially circular, substantially elliptical, substantially hexagonal, substantially octagonal, reform any other geometric or alternative overall cross-sectional shape.

A variety of recesses or apertures may be formed portions of the demolition container 110 to aid in attaching or coupling the demolition container 110 to surfaces or items.

A demolition container aperture 115, defined by one or more interior side walls 114, is formed through the demolition container 110. The demolition container aperture 115 extends from a first demolition container aperture open end 116 formed in the demolition container first end 111, along the one or more demolition container side walls 114, to a second demolition container aperture open end 117 formed in the demolition container second end 112. The first demolition container aperture open end 116 provides access to the demolition container aperture 115.

The one or more demolition container side walls 114 may optionally be formed from any number or combination of wall portions, including, for example, a single, continuous wall portion or multiple coupled or joined wall portions. Thus, the demolition container aperture 115 may optionally be formed by any cavity, partial cavity, or space that is capable of retaining the demolition liner (such as, for example, a conical demolition liner 180, a linear demolition liner 285, a hemispherical demolition liner 380, or a EFP demolition liner 480) and the primary explosive material 190.

In certain exemplary, nonlimiting embodiments, the demolition container side walls 114 comprise a single, continuous, integrally formed wall portion.

It should also be appreciated that while the demolition container aperture 115 is illustrated as being substantially cylindrical, the present disclosure is not so limited. Thus, the demolition container aperture 115 may have an overall cross-sectional shape that is substantially circular, substantially elliptical, substantially hexagonal, substantially octagonal, reform any other geometric or alternative overall cross-sectional shape.

In various exemplary embodiments, the demolition container aperture 115 has a first inner diameter as the demolition container aperture 115 extends from the first demolition container aperture open end 116, toward the demolition container second end 112, to a demolition container aperture shoulder 119. The demolition container aperture 115 then has a second inner diameter as the demolition container aperture 115 extends from the demolition container aperture shoulder 119 to the demolition container second end 112.

In various exemplary embodiments, the demolition container aperture 115 has a first, inner diameter as the demolition container aperture 115 extends from the first demolition container aperture open end 116 to the demolition container aperture shoulder 119. The demolition container aperture 115 then has a second, smaller, inner diameter (as compared to the first inner diameter) as the demolition container aperture 115 extends from the demolition container aperture shoulder 119 to the second demolition container aperture open end 117.

The demolition container 110 includes an extending coupling portion 120 and a recessed coupling portion 124. The extending coupling portion 120 is formed proximate or within a portion of the demolition container second end 112, while the recessed coupling portion 124 is formed proximate or within a portion of the demolition container first end 111.

In various exemplary embodiments, the extending coupling portion 120 may be integrally formed as a portion of the demolition container 110 and may be considered an integral portion of the demolition container 110.

The extending coupling portion 120 extends from a coupling portion surface 121 to the demolition container second end 112. One or more coupling tabs 122 extend from the extending coupling portion 120 of the demolition container 110 at spaced apart locations. A coupling tab shoulder 123 is formed by each coupling tab 122, between a surface of each coupling tab 122 facing the coupling portion surface 121 and the extending coupling portion 120.

The recessed coupling portion 124 is formed between a recess portion surface 125 formed within the demolition container aperture 115 and the demolition container first end 111. In various exemplary embodiments, the recessed coupling portion 124 may be integrally formed within the demolition container 110 and may be considered an integral portion of the demolition container 110.

The recessed coupling portion 124 includes one or more recess locking tabs 126. As illustrated, each recess locking tab 126 extends from a sidewall of the recessed coupling portion 124, proximate the demolition container first end 111, and towards a middle of the demolition container aperture 115.

As illustrated, each recess locking tab 126 of the demolition container 110 is defined between the spaced apart gaps or coupling slots 127 formed between each of the recess locking tabs 126 of the recessed coupling portion 124.

In various exemplary embodiments, the extending coupling portion 120 and the recessed coupling portion 124 may be substantially circular.

In various exemplary embodiments, the extending coupling portion 120 comprises a protrusion configured to fit within at least a portion of the recessed coupling portion 124.

The coupling slots 127 are spaced apart and configured such that each coupling slot 127 is capable of receiving a corresponding coupling tab 122 of the extending coupling portion 120 of the demolition container 110. Furthermore, the recess portion shoulder 128 of each of the recess locking tabs 126 is separated from the recess portion surface 125 by a space allowing the coupling tabs 122 of the extending coupling portion 120 to be rotatable within the recess of the recessed coupling portion 124.

In various exemplary embodiments, each recess locking tab 126 may optionally include a recess stop 129 proximate an end of each recess locking tab 126 and extending from the recess locking tab 126 and between the recess portion shoulder 128 and the recess portion surface 125 of the recessed coupling portion 124. In such exemplary embodiments, when an extending coupling portion 120 of a second demolition container 110 is attached or locked within the recessed coupling portion 124 of a first demolition container 110, the recess stop 129 may prevent the second demolition container 110 from rotating beyond a desired position relative to the first demolition container 110 and being misaligned or coming free from the demolition container 110.

The number of coupling tabs 122 of the extending coupling portion 120 corresponds to the number of coupling slots 127 of the recessed coupling portion 124 of the demolition container 110. Further, the size and configuration of each of the coupling tabs 122 of the extending coupling portion 120 is such that each of the coupling tabs 122 is able to fit within a corresponding coupling slot 127 of the recessed coupling portion 124.

While the demolition container 110 is illustrated as having an extending coupling portion 120 having three coupling tabs 122 and a recessed coupling portion 124 having three coupling slots 127, other exemplary embodiments of the demolition container 110 may optionally include one coupling tab 122 and one coupling slot 127, two coupling tabs 122 and two coupling slots 127, four coupling tabs 122 and four coupling slots 127, five coupling tabs 122 and five coupling slots 127, six coupling tabs 122 and six coupling slots 127, or any other corresponding number of coupling tabs 122 and coupling slots 127.

Figure 35:
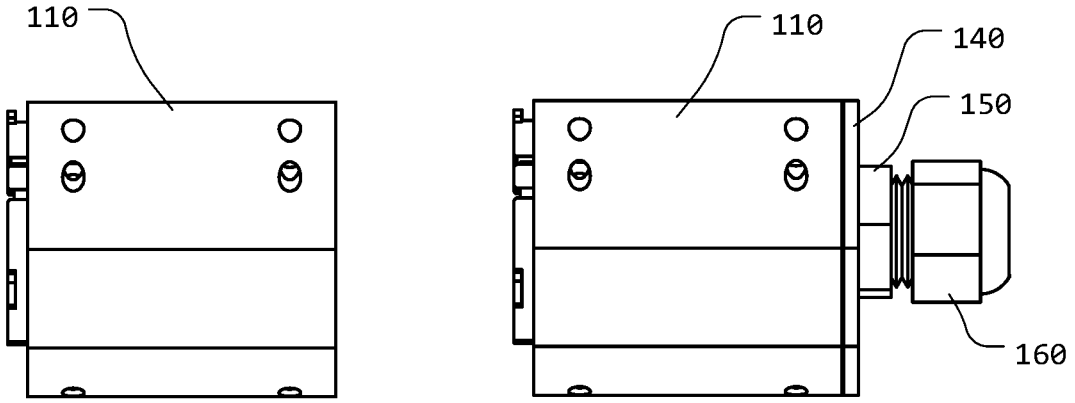
FIG. 35 illustrates a side view of certain exemplary components of a partially assembled exemplary embodiment of a demolition container system, according to the present disclosure.
Figure 36:
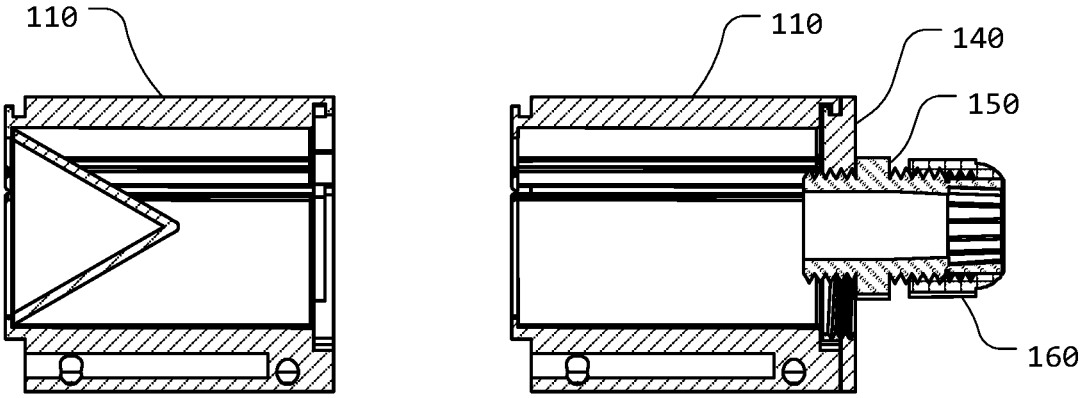
FIG. 36 illustrates an exploded, side, cross-sectional view of certain exemplary components of a partially assembled exemplary embodiment of a demolition container system, according to the present disclosure.
Figure 37:
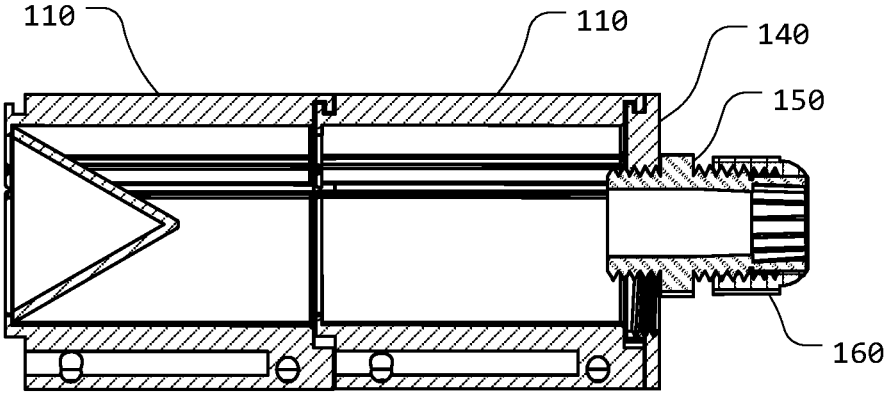
FIG. 37 illustrates an exploded, side, cross-sectional view of certain exemplary components of a partially assembled exemplary embodiment of a demolition container system, according to the present disclosure.

As illustrated, for example, in FIGS. 35-37, a first demolition container 110 and a second demolition container 110 may optionally be attached or coupled directly to one another, via interaction of the recessed coupling portion 124 of the first demolition container 110 and the extending coupling portion 120 of the second demolition container 110.

Thus, it should be appreciated that the extending coupling portion 120 of each demolition container 110 is configured to engage and lock to a corresponding recessed coupling portion 124 of another demolition container 110. During attachment or coupling of the demolition containers 110, the coupling tabs 122 of the extending coupling portion 120 are initially aligned with the coupling slots 127 of the recessed coupling portion 124. Once appropriately aligned, the coupling tabs 122 are urged through the respective coupling slots 127 and coupling tabs 122 of the extending coupling portion 120 of the first demolition container 110 are positioned within at least a portion of the recessed coupling portion 124 of the second demolition container 110. Once appropriately positioned, the extending coupling portion 120 is twisted, relative to the recessed coupling portion 124, within the recessed coupling portion 124 such that the coupling tabs 122 of the extending coupling portion 120 are positioned under at least a portion of the recess locking tabs 126 of the recessed coupling portion 124.

Once appropriately positioned, excessive or further twisting of the extending coupling portion 120 relative to the recessed coupling portion 124 is limited due to interaction between the coupling tabs 122 and the recess stops 129 at the end of each of the recess locking tabs 126 of the recessed coupling portion 124.

While FIGS. 35-37 illustrate various views of the demolition containers 110 and shows the extending coupling portion 120 aligned with the recessed coupling portion 124 with the coupling tabs 122 of the extending coupling portion 120 adjacent the recess locking tabs 126 of the recessed coupling portion 124, it is understood that in order for the extending coupling portion 120 be coupled or locked within the recessed coupling portion 124 the coupling tabs 122 of the extending coupling portion 120 must pass through the coupling slots 127 between the recess locking tabs 126 of the recessed coupling portion 124 and the extending coupling portion 120 must be rotated so the coupling slots 127 of the extending coupling portion 120 are under the recess locking tabs 126 of the recessed coupling portion 124.

In various exemplary embodiments, the recessed coupling portion 124 of the demolition container 110 may be considered the female end or female coupling element and the extending coupling portion 120 of the demolition container 110 may be considered the male end or male coupling element inasmuch as it is received by the female end or female coupling element. In other exemplary embodiments the recessed coupling portion 124 may be the male end or male coupling element and the extending coupling portion 120 may be considered the female end or female coupling element.

In other exemplary embodiments, the demolition container 110 may optionally include other locking mechanisms configured to attach the extending coupling portion 120 to the recessed coupling portion 124, such as, for example, external threads formed in at least a portion of the extending coupling portion 120 and corresponding internal threads formed in at least a portion of the recessed coupling portion 124.

Once appropriately attached or coupled together, the demolition container apertures 115 of the attached or coupled first and second demolition containers 110 (and the recessed channels 130) are aligned and in fluid communication with one another, thereby increasing the aggregate or cumulative demolition container aperture 115. In this manner, additional explosive material may be positioned within the aggregate or cumulative demolition container aperture 115.

To release the demolition containers 110 the extending coupling portion 120 is rotated so that the coupling tabs 122 of the extending coupling portion 120 are aligned with the coupling slots 127 between the recess locking tabs 126 of the recessed coupling portion 124. Once appropriately aligned, a withdrawing force is applied to the extending coupling portion 120 and the coupling tabs 122 of the extending coupling portion 120 are withdrawn from the coupling slots 127, thereby separating the demolition containers 110 from one another.

Thus, a first demolition container 110 can be rotated between an unlocked position, as illustrated in FIGS. 35 and 36, and a locked position, as illustrated in FIG. 37, relative to a second demolition container 110.

A plurality of recessed channels 130 are formed in the interior side walls 114. The recessed channels 130 extend, substantially parallel to the longitudinal axis, $A_L$, from the demolition container second end 112 to the recess portion surface 125.

Figure 34:
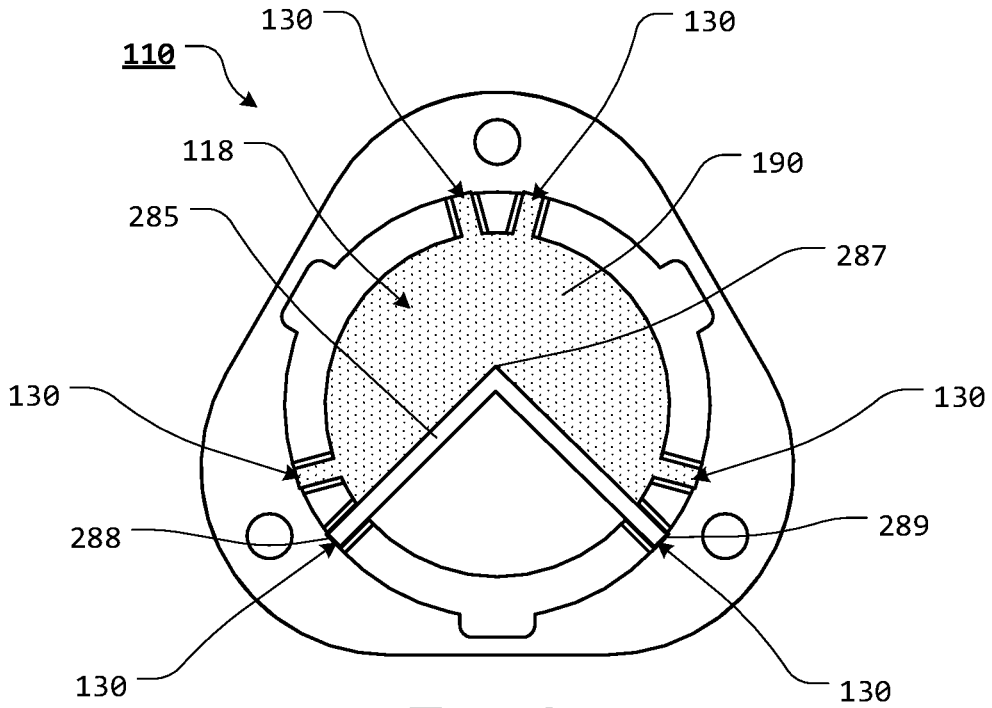
FIG. 34 illustrates a side, cross-sectional view of certain exemplary components of an assembled exemplary embodiment of a demolition container system utilizing the demolition liner of FIG. 33.

In various exemplary embodiments, as illustrated, the recessed channels 130 are formed in spaced apart pairs. For example, spaced apart pairs of recessed channels 130 may be formed at relative 12 o'clock, 4 o'clock, and 8 o'clock positions relative to the demolition container aperture 115, when viewed as illustrated in FIG. 34.

By providing recessed channels 130, various liner options may be positioned and utilized within the demolition container aperture 115. For example, as illustrated in FIG. 34, an exemplary linear demolition liner 280, which extends from a relative apex 287 to two legs 288 and 289, is placed within the demolition container aperture 115 such that portions of opposing legs 288 and 289 of the linear demolition liner 280 are inserted at least partially within recessed channels 130. In this manner, the linear demolition liner 280 in an appropriate position within the demolition container aperture 115. With the linear demolition liner 280 appropriately positioned within the demolition container aperture 115, a demolition container cavity 118 is formed between a portion of the linear demolition liner 280 and at least the recess portion surface 125 of the recessed coupling portion 124 and at least a portion of the one or more demolition container side walls 114 of the demolition container aperture 115.

Once appropriately positioned, and primary explosive material 190 may be placed within a desired portion of the demolition container aperture 115. By utilizing the exemplary linear demolition liner 280, the demolition container system 100 provides a linear cutting option. In certain exemplary embodiments, the demolition container system 100 with the linear demolition liner 280 may be used to cut steel or perform work functions where a cutting function is required. This configuration, when appropriately packed with a primary explosive material 190 can effectively cut through ½ inch or more of steel.

In various exemplary embodiments, the demolition container 110 is formed of a substantially rigid, nonmetallic and/or nonconductive, polymer material, such as, for example, a polycarbonate plastic (such as a polycarbonate, made from bisphenol A (BPA) and phosgene ($COCl_2$)), polyester, polysulfone, or polyester ketone.

In various exemplary embodiments, the demolition container 110 is formed of an integral portion of material or unit. Alternatively, suitable materials can be used and sections or elements made independently and attached or coupled together, such as by adhesives, welding, screws, rivets, pins, or other fasteners, to form the demolition container 110.

The demolition container cap 140 includes a cap portion 141 and an extending cap coupling portion 143. The cap portion 141 extends from a first surface to a cap portion surface 142. The extending cap coupling portion 143 is formed so as to extend from a portion of a cap portion surface 142.

In various exemplary embodiments, the extending cap coupling portion 143 may be integrally formed as a portion of the demolition container cap 140 and may be considered an integral portion of the demolition container cap 140.

One or more cap coupling tabs 144 extend from the extending cap coupling portion 143 of the demolition container cap 140 at spaced apart locations. A cap coupling tab shoulder 145 is formed by each cap coupling tab 144, between a surface of each cap coupling tab 144 facing the cap portion surface 142 and the extending cap coupling portion 143.

In various exemplary embodiments, the extending cap coupling portion 143 comprises a protrusion configured to fit within at least a portion of the recessed coupling portion 124.

The coupling slots 127 are spaced apart and configured such that each coupling slot 127 is capable of receiving a corresponding cap coupling tab 144 of the extending cap coupling portion 143 of the demolition container cap 140. Furthermore, the recess portion shoulder 128 of each of the recess locking tabs 126 is separated from the recess portion surface 125 by a space allowing the cap coupling tabs 144 of the extending cap coupling portion 143 to be rotatable within the recess of the recessed coupling portion 124.

In various exemplary embodiments, when an extending cap coupling portion 143 of a demolition container cap 140 is attached or locked within the recessed coupling portion 124 of a demolition container 110, the recess stop 129 may prevent the demolition container cap 140 from rotating beyond a desired position relative to the demolition container 110 and being misaligned or coming free from the demolition container cap 140.

The number of cap coupling tabs 144 of the extending cap coupling portion 143 corresponds to the number of coupling slots 127 of the recessed coupling portion 124 of the demolition container 110. Further, the size and configuration of each of the cap coupling tabs 144 of the extending cap coupling portion 143 is such that each of the cap coupling tabs 144 is able to fit within a corresponding coupling slot 127 of the recessed coupling portion 124.

While the demolition container cap 140 is illustrated as having an extending cap coupling portion 143 having three cap coupling tabs 144 and a recessed coupling portion 124 having three coupling slots 127, other exemplary embodiments of the demolition container cap 140 may optionally include one cap coupling tab 144, two cap coupling tabs 144, four cap coupling tabs 144, five cap coupling tabs 144, six cap coupling tabs 144, or any other number of cap coupling tabs 144, so long as there is a corresponding or greater number of coupling slots 127 formed in the recessed coupling portion 124.

Figure 22:
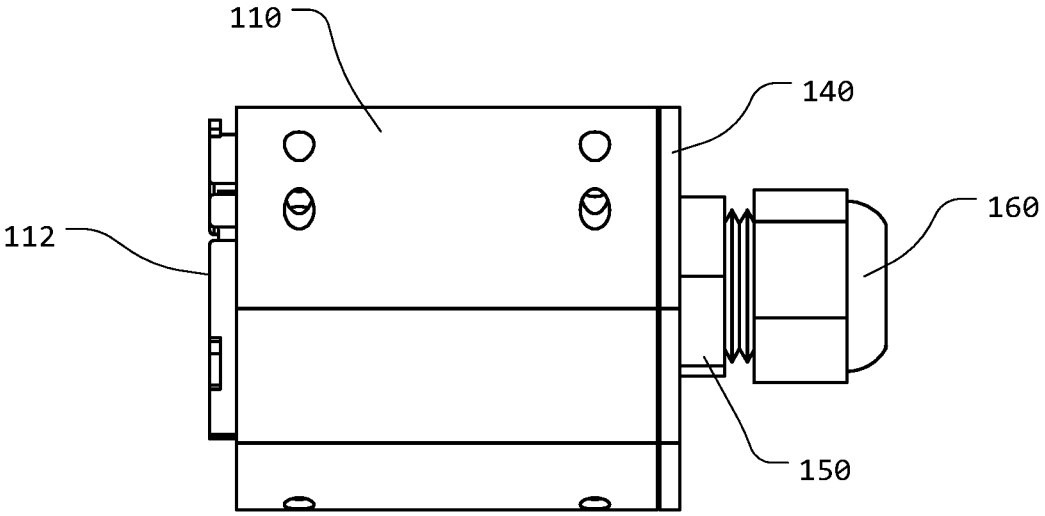
FIG. 22 illustrates a side view of certain exemplary components of an assembled exemplary embodiment of a demolition container system, according to the present disclosure.
Figure 23:
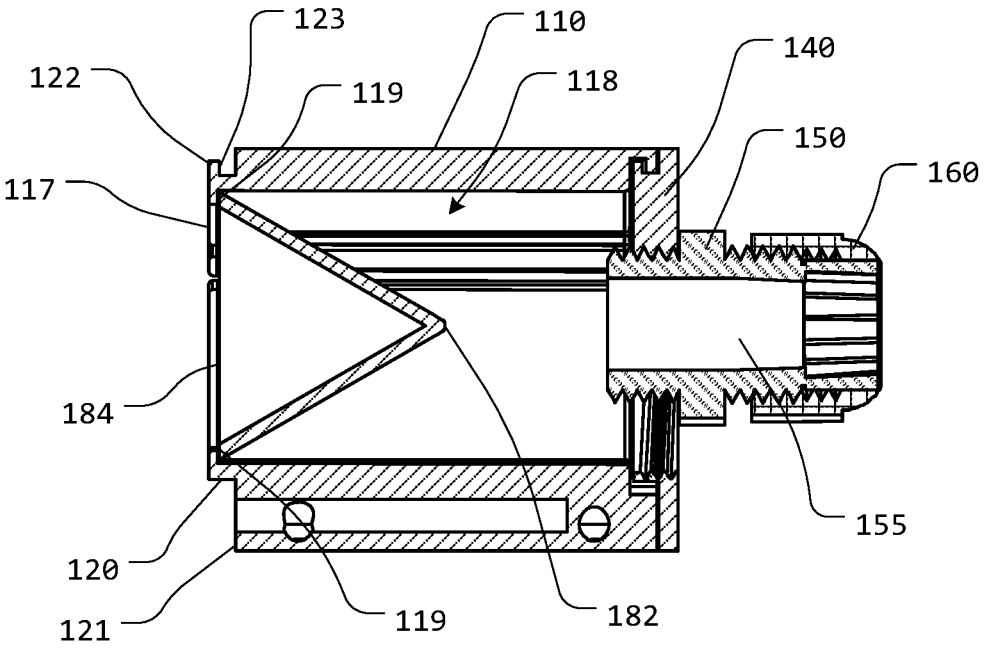
FIG. 23 illustrates a side, cross-sectional view of certain exemplary components of an assembled exemplary embodiment of a demolition container system, according to the present disclosure.
Figure 24:
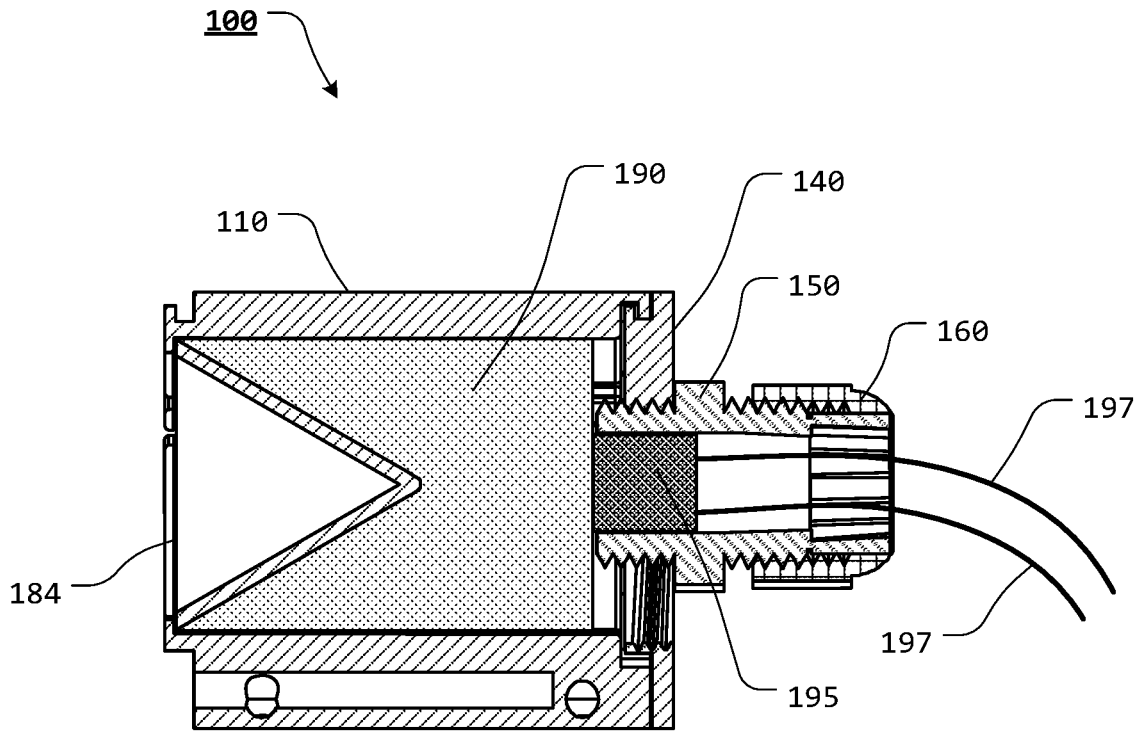
FIG. 24 illustrates a side, cross-sectional view of certain exemplary components of an assembled exemplary embodiment of a demolition container system packed with an exemplary explosive material, according to the present disclosure.
Figure 25:
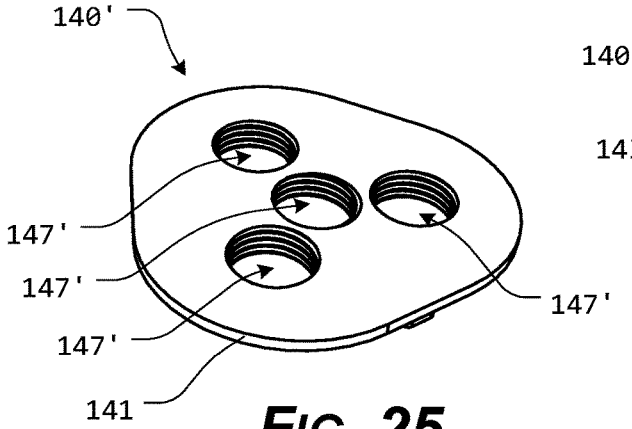
FIG. 25 illustrates an upper perspective view of certain exemplary components of an exemplary embodiment of a demolition container cap, according to the present disclosure.
Figure 26:
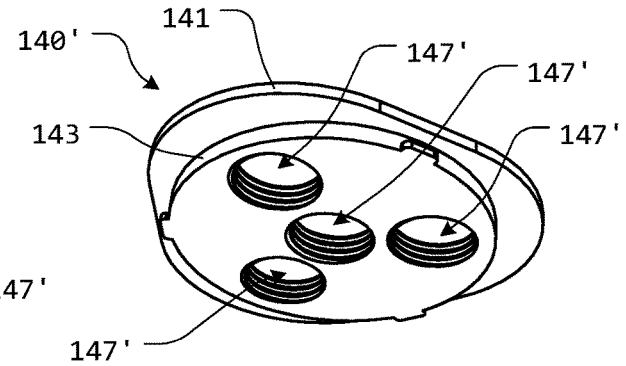
FIG. 26 illustrates a lower perspective view of certain exemplary components of an exemplary embodiment of a demolition container cap, according to the present disclosure.
Figure 27:
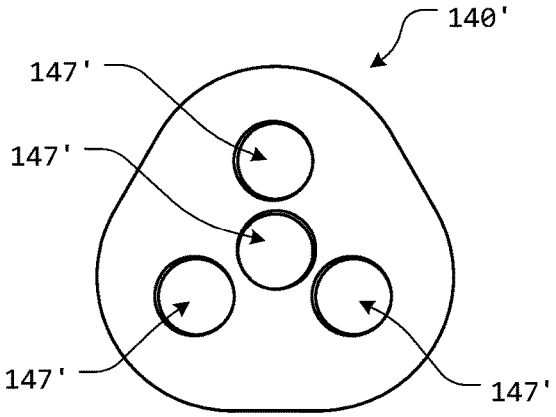
FIG. 27 illustrates a top view of certain exemplary components of an exemplary embodiment of a demolition container cap, according to the present disclosure.
Figure 28:
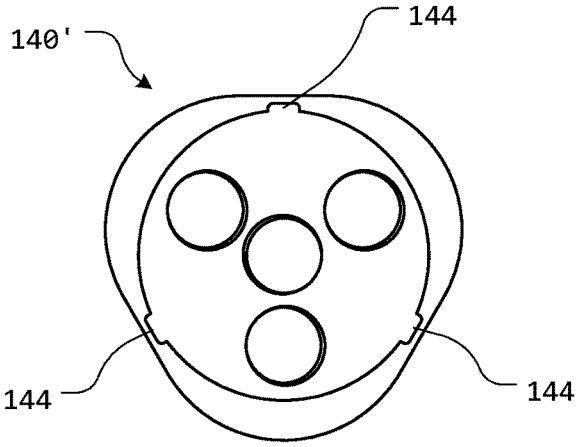
FIG. 28 illustrates a bottom view of certain exemplary components of an exemplary embodiment of a demolition container cap, according to the present disclosure.

As illustrated, for example, in FIGS. 22-24, a demolition container 110 and a demolition container cap 140 may optionally be attached or coupled directly to one another, via interaction of the recessed coupling portion 124 of the demolition container 110 and the extending cap coupling portion 143 of the demolition container cap 140.

Thus, it should be appreciated that the extending cap coupling portion 143 of the demolition container cap 140 is configured to engage and lock to a corresponding recessed coupling portion 124 of a demolition container 110. During attachment or coupling of the demolition container cap 140 and the demolition container 110, the cap coupling tabs 144 of the extending cap coupling portion 143 are initially aligned with the coupling slots 127 of the recessed coupling portion 124. Once appropriately aligned, the cap coupling tabs 144 are urged through the respective coupling slots 127 and cap coupling tabs 144 of the extending cap coupling portion 143 of the demolition container cap 140 are positioned within at least a portion of the recessed coupling portion 124 of the demolition container 110. Once appropriately positioned, the demolition container cap 140 is twisted, relative to the recessed coupling portion 124, within the recessed coupling portion 124 such that the cap coupling tabs 144 of the extending cap coupling portion 143 are positioned under at least a portion of the recess locking tabs 126 of the recessed coupling portion 124.

Once appropriately positioned, excessive or further twisting of the demolition container cap 140 relative to the recessed coupling portion 124 is limited due to interaction between the cap coupling tabs 144 and the recess stops 129 at the end of each of the recess locking tabs 126 of the recessed coupling portion 124.

While FIGS. 23-24 illustrate the demolition container 110 and the demolition container cap 140 and shows the extending cap coupling portion 143 aligned with the recessed coupling portion 124 with the cap coupling tabs 144 of the extending cap coupling portion 143 adjacent the recess locking tabs 126 of the recessed coupling portion 124, it is understood that in order for the extending cap coupling portion 143 be coupled or locked within the recessed coupling portion 124 the cap coupling tabs 144 of the extending cap coupling portion 143 must pass through the coupling slots 127 between the recess locking tabs 126 of the recessed coupling portion 124 and the extending cap coupling portion 143 must be rotated so the coupling slots 127 of the extending cap coupling portion 143 are under the recess locking tabs 126 of the recessed coupling portion 124.

To release the demolition container cap 140 from the demolition container 110, the demolition container cap 140 is rotated so that the cap coupling tabs 144 of the extending cap coupling portion 143 are aligned with the coupling slots 127 between the recess locking tabs 126 of the recessed coupling portion 124. Once appropriately aligned, a withdrawing force is applied to the demolition container cap 140 and the cap coupling tabs 144 of the extending cap coupling portion 143 are withdrawn from the coupling slots 127, thereby separating the demolition container cap 140 from the demolition container 110.

Figure 20:
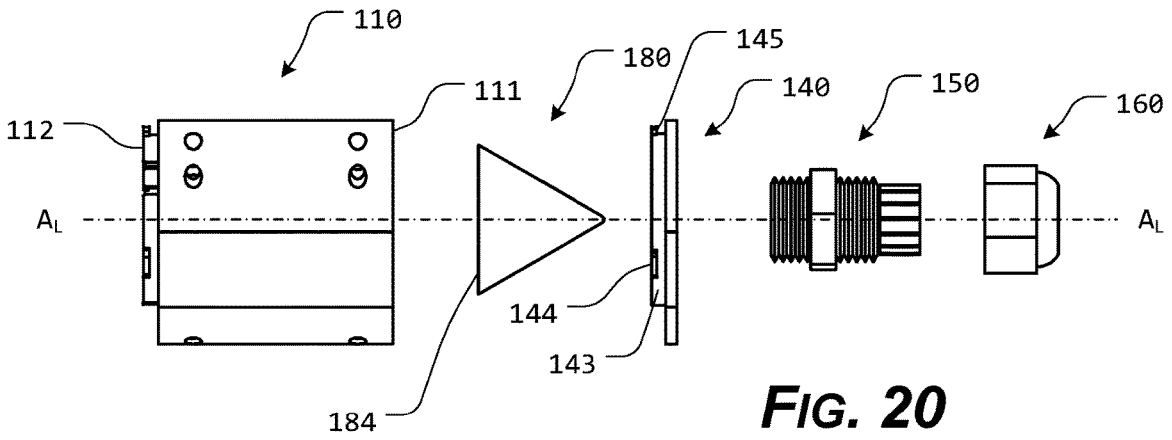
FIG. 20 illustrates an exploded, side view of certain exemplary components of a partially assembled exemplary embodiment of a demolition container system, according to the present disclosure.
Figure 21:
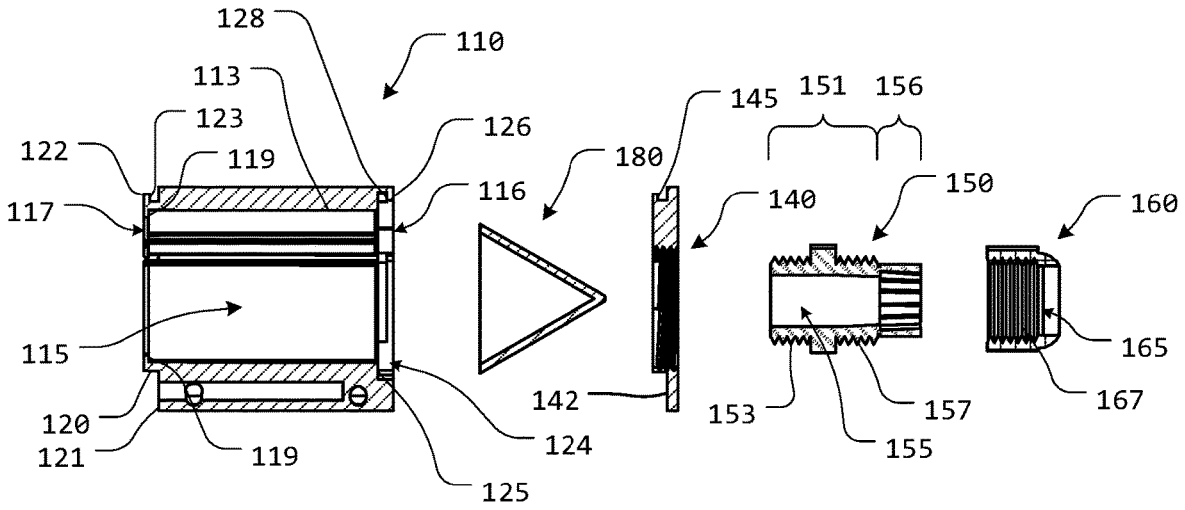
FIG. 21 illustrates an exploded, side, cross-sectional view of certain exemplary components of a partially assembled exemplary embodiment of a demolition container system, according to the present disclosure.

Thus, the demolition container cap 140 can be rotated between an unlocked position, as illustrated in FIGS. 20 and 21, and a locked position, as illustrated in FIGS. 20 to and 23, relative to the demolition container 110.

In various exemplary embodiments, the extending cap coupling portion 143 of the demolition container cap 140 may be considered the male end or male coupling element inasmuch as it is received by the female end or female coupling element of the demolition container 110. In other exemplary embodiments, the extending cap coupling portion 143 may be considered the female end or female coupling element.

In other exemplary embodiments, the demolition container cap 140 may optionally include other locking mechanisms configured to attach the extending cap coupling portion 143 to the recessed coupling portion 124, such as, for example, external threads formed in at least a portion of the extending cap coupling portion 143 and corresponding internal threads formed in at least a portion of the recessed coupling portion 124.

If/when the demolition container cap 140 is appropriately attached or coupled to the demolition container 110, the demolition container cap 140 acts as a cap for the demolition container aperture open end 116 and closes the demolition container aperture open end 116 of the demolition container aperture 115 of the demolition container 110.

A demolition container cap aperture 147 is formed through the body of the demolition container cap 140. The demolition container cap aperture 147 is sized so as to allow at least a portion of the strain relief connector body portion 151 to be positioned therethrough, such that the external strain relief connector body threads 153 of the strain relief connector 150 extend through at least a portion of the demolition container cap aperture 147 and into the demolition container cap recess 142.

In certain exemplary embodiments, the demolition container cap aperture 147 is a single, substantially circular aperture. Alternatively, as illustrated, the demolition container cap aperture 147 comprises multiple, at least partially overlapping apertures.

In various exemplary embodiments, the demolition container cap aperture 147 includes cap aperture threads 148 formed so as to interact with the external strain relief connector body threads 153 of the strain relief connector 150. Thus, interaction between the cap aperture threads 148 of the demolition container cap 140 and the external strain relief connector body threads 153 of the strain relief connector 150 allow the strain relief connector 150 to be threadedly secured to the demolition container cap 140.

In various exemplary embodiments, the demolition container cap 140 is formed of a substantially rigid, nonmetallic and/or nonconductive, polymer material, such as, for example, a polycarbonate plastic (such as a polycarbonate, made from bisphenol A (BPA) and phosgene ($COCl_2$)), polyester, polysulfone, or polyester ketone.

In various exemplary embodiments, the demolition container cap 140 is formed of an integral portion of material or unit. Alternatively, suitable materials can be used and sections or elements made independently and attached or coupled together, such as by adhesives, welding, screws, rivets, pins, or other fasteners, to form the demolition container cap 140.

FIGS. 25-28 illustrate an alternative exemplary embodiment of the demolition container cap 140', wherein the demolition container cap 140' includes four exemplary demolition container cap apertures 147'. Thus, it should be appreciated that the number and positioning of the demolition container cap apertures 147 and/or demolition container cap apertures 147' is a design choice, based upon the desired use of the demolition container system 100.

The strain relief connector 150 includes a strain relief connector body portion 151 and a strain relief connector claw portion 156. A strain relief connector borehole 155 is formed through the strain relief connector 150.

External strain relief connector body threads 153 are formed within at least a portion of the strain relief connector body portion 151 and are formed so as to interact with the demolition container cap apertures 147, so that the strain relief connector 150 can be threadedly attached to the demolition container cap 140.

External connector nut threads 157 are also formed in the strain relief connector body portion 151. The external connector nut threads 157 are formed so as to extend away from the strain relief connector external strain relief connector body threads 153. The external connector nut threads 157 are formed so as to interact with connector nut internal threads 167 of a connector nut 160 so that the connector nut 160 can be threadedly attached to the strain relief connector 150.

When the connector nut 160 is threadedly attached to the strain relief connector 150, a connector nut borehole 165 of the connector nut 160 is aligned with the strain relief connector borehole 155. As the connector nut 160 is further secured to the strain relief connector 150, interaction between the connector nut 160 and the strain relief connector claw portion 156 causes an inner diameter of the strain relief connector borehole 155, within the strain relief connector claw portion 156, to be restricted or reduced, acting to further secure an item, such as, for example, an initiating explosive material 195 within the strain relief connector borehole 155.

A variety of demolition liners may be utilized in conjunction with the demolition container 110 to form the demolition container system 100. For example, a liner having a substantially linear shape, such as linear demolition liner 280, may optionally be used, as described herein.

In various exemplary embodiments, a conical liner shape may optionally be used, for example, to penetrate thick materials. In these exemplary embodiments, a demolition liner such as the conical demolition liner 180 may be utilized. The conical demolition liner 180 extends from a relative apex 182 to a base 184 and includes a recessed portion 285 extending from the base 184 toward the relative apex 182. The relative circumference of the base 184 is less than the first inner diameter of the demolition container aperture 115 and greater than the second inner diameter of the demolition container aperture 115. Thus, the conical demolition liner 180 may be inserted, base 184 first, into the first demolition container aperture open end 116 and urged into the demolition container aperture 115, toward the demolition container second end 112. The conical demolition liner 180 is able to be urged into the demolition container aperture 115, until at least a portion of the base 184 contacts the demolition container aperture shoulder 119. In this position, the recessed portion 185 faces the second demolition container aperture open end 117. When the portion of the base 184 contacts the demolition container aperture shoulder 119, interaction between portion of the base 184 and a portion of the demolition container aperture shoulder 119 maintains the conical demolition liner 180 in an appropriate position within the demolition container aperture 115.

With the conical demolition liner 180 appropriately positioned within the demolition container aperture 115, a demolition container cavity 118 is formed between the conical demolition liner 180 and at least the recess portion surface 125 of the recessed coupling portion 124.

In this configuration, the demolition container system 100 with conical demolition liner 180 may optionally be used to penetrate materials like thick cased munitions to detonate the munition or boreholes through steel or rock for construction purposes. This configuration and liner when packed correctly with a primary explosive material 190 can effectively cut through 2 inches of steel.

Figure 29:
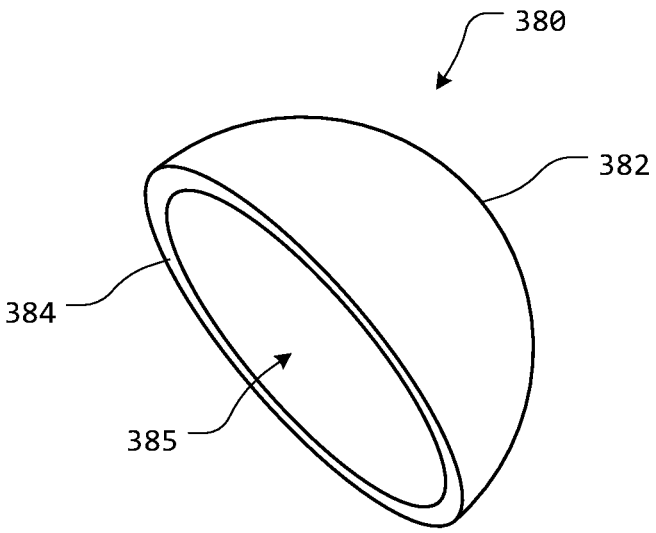
FIG. 29 illustrates a perspective view of an exemplary embodiment of a demolition liner, according to the present disclosure.
Figure 30:
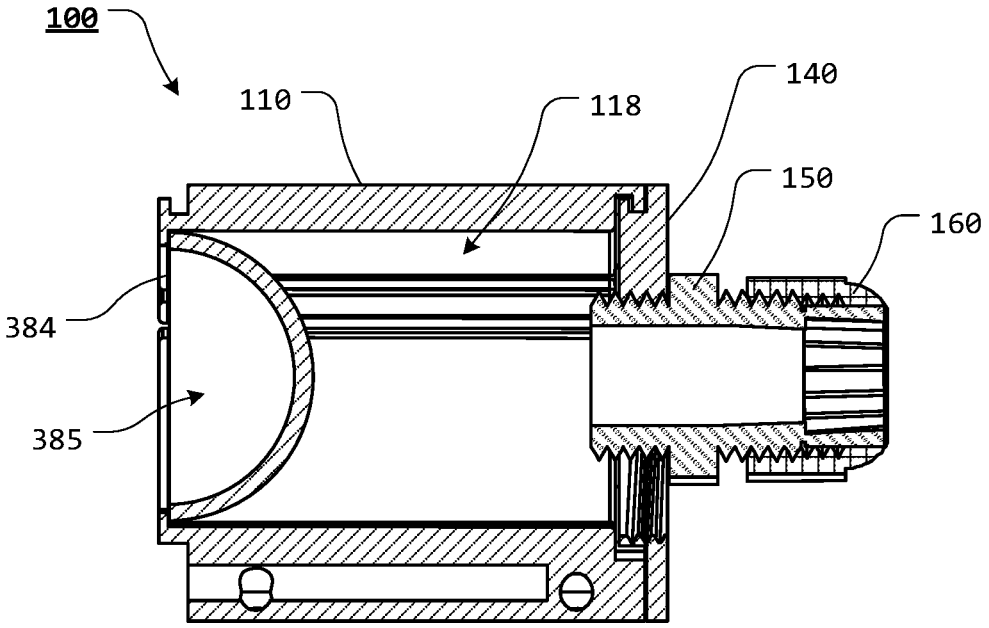
FIG. 30 illustrates a side, cross-sectional view of certain exemplary components of an assembled exemplary embodiment of a demolition container system utilizing the demolition liner of FIG. 29, according to the present disclosure.
Figure 31:
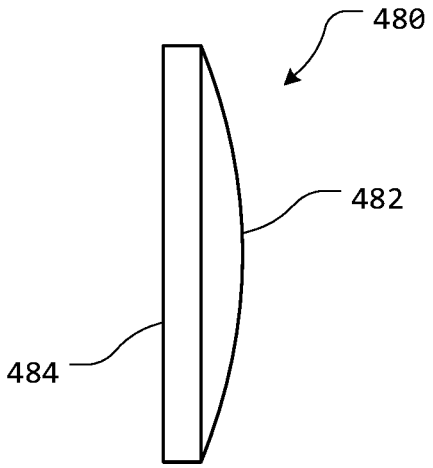
FIG. 31 illustrates a perspective view of an exemplary embodiment of a demolition liner, according to the present disclosure.

In various exemplary embodiments, as illustrated in FIGS. 29-30, a hemispherical liner shape may optionally be used, for example, to penetrate thick materials. In these exemplary embodiments, a demolition liner such as the hemispherical demolition liner 380 may be utilized. The hemispherical demolition liner 380 extends from a relative apex 382 to a base 384 and includes a recessed portion 385 extending from the base 384 toward the relative apex 382. The relative circumference of the base 384 is less than the first inner diameter of the demolition container aperture 115 and greater than the second inner diameter of the demolition container aperture 115. Thus, the hemispherical demolition liner 380 may be inserted, base 384 first, into the first demolition container aperture open end 116 and urged into the demolition container aperture 115, toward the demolition container second end 112. The hemispherical demolition liner 380 is able to be urged into the demolition container aperture 115, until at least a portion of the base 384 contacts the demolition container aperture shoulder 119. In this position, the recessed portion 385 faces the second demolition container aperture open end 117. When the portion of the base 384 contacts the demolition container aperture shoulder 119, interaction between portion of the base 384 and a portion of the demolition container aperture shoulder 119 maintains the hemispherical demolition liner 380 in an appropriate position within the demolition container aperture 115.

With the hemispherical demolition liner 380 appropriately positioned within the demolition container aperture 115, a demolition container cavity 118 is formed between the hemispherical demolition liner 380 and at least the recess portion surface 125 of the recessed coupling portion 124.

In this configuration, the demolition container system 100 with hemispherical demolition liner 380 may optionally be used to penetrate materials like thick cased munitions to detonate the munition or boreholes through steel or rock for construction purposes. This configuration, with the with hemispherical demolition liner 380, when packed correctly with a primary explosive material 190 can effectively cut through 2 inches of steel.

Figure 32:
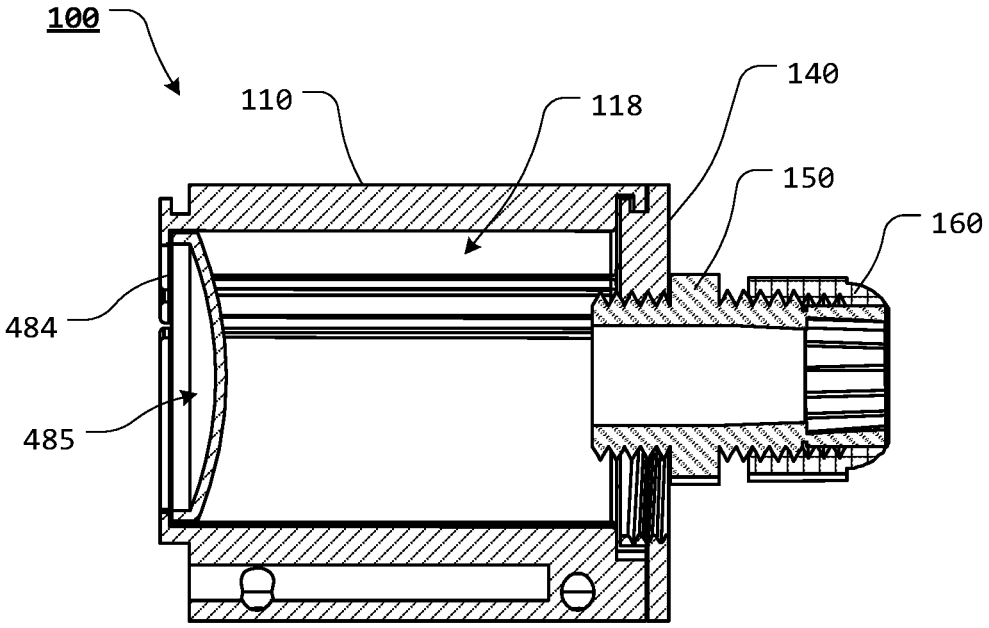
FIG. 32 illustrates a side, cross-sectional view of certain exemplary components of an assembled exemplary embodiment of a demolition container system utilizing the demolition liner of FIG. 31.
Figure 33:
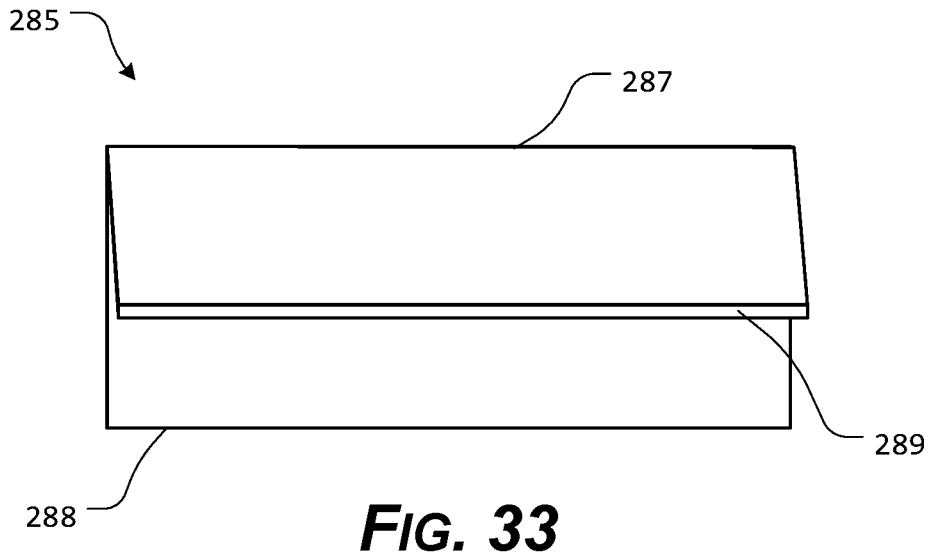
FIG. 33 illustrates a perspective view of an exemplary embodiment of a demolition liner, according to the present disclosure.

In various exemplary embodiments, as illustrated in FIGS. 41-32, an Explosively Formed Projectile (EFP) liner shape may optionally be used, for example, to shear and break things apart. In these exemplary embodiments, a demolition liner such as the EFP demolition liner 480 may be utilized. The EFP demolition liner 480 extends from a relative apex 482 to a base 484 and includes a recessed portion 485 extending from the base 484 toward the relative apex 482. The relative circumference of the base 484 is less than the first inner diameter of the demolition container aperture 115 and greater than the second inner diameter of the demolition container aperture 115. Thus, the EFP demolition liner 480 may be inserted, base 484 first, into the first demolition container aperture open end 116 and urged into the demolition container aperture 115, toward the demolition container second end 112. The EFP demolition liner 480 is able to be urged into the demolition container aperture 115, until at least a portion of the base 484 contacts the demolition container aperture shoulder 119. In this position, the recessed portion 485 faces the second demolition container aperture open end 117. When the portion of the base 484 contacts the demolition container aperture shoulder 119, interaction between portion of the base 484 and a portion of the demolition container aperture shoulder 119 maintains the EFP demolition liner 480 in an appropriate position within the demolition container aperture 115.

With the EFP demolition liner 480 appropriately positioned within the demolition container aperture 115, a demolition container cavity 118 is formed between the EFP demolition liner 480 and at least the recess portion surface 125 of the recessed coupling portion 124.

In this configuration, the demolition container system 100 with EFP demolition liner 480 can remotely access, disarm/neutralize or detonate hazardous military ordnance or boreholes through steal or rock for construction purposes. This configuration and liner when packed correctly with a primary explosive material 190 can effectively cut through 0.5 inches of steel.

In various exemplary embodiments, the may be formed of copper or aluminum. However, it should be appreciated that the present disclosure is not so limited and the may be formed of any desired material.

It should also be appreciated that the size and shape of the demolition container aperture 115 and/or the demolition container cavity 118 may be such that a specific amount of primary explosive material 190 can be contained within the demolition container aperture 115 and/or the demolition container cavity 118 and the size and shape of the strain relief connector borehole 155 may be such that a specific amount of initiating explosive material 195 can be contained within the strain relief connector borehole 155. Thus, during use, a user does not need to measure the amounts of primary explosive material 190 and initiating explosive material 195 to be used, but may merely fill the demolition container aperture 115 and/or the demolition container cavity 118 with a primary explosive material 190 and fill the strain relief connector borehole 155 with an initiating explosive material 195.

During assembly and use of the demolition container system 100, a demolition container 110 is initially presented and a selected demolition liner (such as, for example, a conical demolition liner 180, a linear demolition liner 285, a hemispherical demolition liner 380, or a EFP demolition liner 480) is positioned within the demolition container aperture 115 to create a demolition container cavity 118, as described herein.

An appropriate amount of a primary explosive material 190 is positioned within the demolition container cavity 118, behind the selected demolition liner. Once the demolition container cavity 118 of the demolition container aperture 115 is appropriately packed with the primary explosive material 190, such that at least a portion of the primary explosive material 190 is in intimate contact with the selected demolition liner, the demolition container cap 140 is then attached or coupled to the demolition container 110, as described herein.

In various exemplary embodiments, the primary explosive material 190 may comprise C4. In various exemplary embodiments, the primary explosive material 190 is packed within the demolition container cavity 118 until the primary explosive material 190 fills the demolition container cavity 118 from the demolition liner to the recess portion surface 125.

Then, as illustrated in FIG. 24, the strain relief connector body portion 151 is positioned through at least a portion of the demolition container cap aperture 147 and the strain relief connector external strain relief connector body threads 153 interact with the cap aperture threads 148 to secure the strain relief connector 150 to the demolition container cap 140. The connector nut 160 is initially threadedly attached or coupled to the strain relief connector external connector nut threads 157.

The strain relief connector 150 is then used to seat and hold in place an initiating explosive material 195 within the strain relief connector borehole 155 that is used to ignite or initiate explosion of the demolition container system 100.

If the initiating explosive material 195 comprises a blast cap, once the demolition container cavity 118 of the demolition container aperture 115 is appropriately packed with the primary explosive material 190, as described herein, the demolition container system 100 is ready for use.

If the initiating explosive material 195 comprises a detonation cord pigtail, a loop of detonation cord is filled with the initiating explosive material 195 (or some other appropriate explosive material) and the detonation cord is urged within the strain relief connector borehole 155 to contact the initiating explosive material 195 within the strain relief connector borehole 155 to ensure there is explosive continuity between the materials. If required for ignition of the initiating explosive material 195, an initiating device may be attached or coupled, via connecting elements 197, to the initiating explosive material 195. The demolition container system 100 is then ready for use.

Once the primary explosive material 190 and the initiating explosive material 195 have been appropriately positioned within the demolition container aperture 115 and/or the demolition container cavity 118 and the strain relief connector borehole 155, respectively, the conical demolition liner 180 will appear substantially as is illustrated in FIG. 24.

A more detailed explanation of the instructions regarding how to utilize the demolition container system is not provided herein because it is believed that the level of description provided herein is sufficient to enable one of ordinary skill in the art to understand and practice the systems, methods, and apparatuses, as described.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A demolition container system, comprising:

a demolition container extending from a demolition container first end to a demolition container second end and having an exterior surface, wherein a demolition container aperture, defined by one or more side walls, is formed through said demolition container, extending from a first demolition container aperture open end formed in said demolition container first end to a second demolition container aperture open end formed in said demolition container second end, wherein said demolition container aperture has a first inner diameter as said demolition container aperture extends from said first demolition container aperture open end, toward said demolition container second end, to a demolition container aperture shoulder, wherein said demolition container aperture has a second inner diameter as said demolition container aperture extends from said demolition container aperture shoulder to said demolition container second end, wherein an extending coupling portion is formed proximate or within a portion of said demolition container second end and a recessed coupling portion is formed proximate or within a portion of said demolition container first end, wherein said extending coupling portion extends from a coupling portion surface to said demolition container second end, wherein one or more coupling tabs extend, at spaced apart locations, from said extending coupling portion, and wherein a coupling tab shoulder is formed between a surface of each coupling tab and said extending coupling portion, wherein said recessed coupling portion is formed between a recess portion surface formed within said demolition container aperture and said demolition container first end, wherein said recessed coupling portion includes one or more recess locking tabs, wherein each recess locking tab extends from a sidewall of said recessed coupling portion, proximate said demolition container first end, and towards a middle of said demolition container aperture, and wherein a coupling slot is defined between each of said recess locking tabs, and wherein a plurality of recessed channels are formed in said side walls, extending from said demolition container second end to said recess portion surface;

a demolition container cap, wherein said demolition container cap includes a cap portion having a cap portion surface, wherein an extending cap coupling portion extends from a portion of said cap portion surface, wherein one or more cap coupling tabs extend from said extending cap coupling portion at spaced apart locations, wherein a cap coupling tab shoulder is formed between a surface of each cap coupling tab and said extending cap coupling portion, wherein at least one demolition container cap aperture is formed through said demolition container cap, wherein said demolition container cap aperture includes internal cap aperture threads, and wherein said demolition container and said demolition container cap are releasably attached or coupled to one another, via interaction of said recessed coupling portion of said demolition container and said extending cap coupling portion of said demolition container cap;

a strain relief connector having a strain relief connector body portion, wherein external strain relief connector body threads are formed in at least a portion of said strain relief connector body portion, said strain relief connector body portion being at least partially insertable through said demolition container cap aperture such that at least a portion of said external strain relief connector body threads extend through said demolition container cap aperture, said external strain relief connector body threads formed so as to interact with cap aperture threads to repeatably threadedly attached said strain relief connector to said demolition container cap; and at least one demolition liner, wherein said at least one demolition liner is insertable into said first demolition container aperture open end and urged into said demolition container aperture such that at least a portion of said at least one demolition liner contacts said demolition container aperture shoulder and interaction between at least a portion of said at least one demolition liner and a portion of said demolition container aperture shoulder maintains said at least one demolition liner within said demolition container aperture and a demolition container cavity is formed between said at least one demolition liner and at least said recess portion surface of said recessed coupling portion.

2. The demolition container system of claim 1, wherein said demolition container includes a longitudinal axis extending from said demolition container first end to said demolition container second end.

3. The demolition container system of claim 1, wherein said exterior surface of said demolition container has a substantially triangular cross-sectional shape.

4. The demolition container system of claim 1, wherein said side walls are formed of a single, continuous, integrally formed wall portion.

5. The demolition container system of claim 1, wherein said side walls are formed of multiple coupled or joined wall portions.

6. The demolition container system of claim 1, wherein said demolition container aperture has a substantially cylindrical overall cross-sectional shape.

7. The demolition container system of claim 1, wherein said second, inner diameter of said demolition container aperture is smaller than said first, inner diameter of said demolition container aperture.

8. The demolition container system of claim 1, wherein at least one of said recess locking tabs includes a recess stop proximate an end of said recess locking tab extending between said recess portion shoulder and said recess portion surface of said recessed coupling portion.

9. The demolition container system of claim 1, wherein a number of coupling tabs of said extending coupling portion corresponds to a number of coupling slots of said recessed coupling portion.

10. The demolition container system of claim 1, wherein said recessed channels are formed in spaced apart pairs.

11. The demolition container system of claim 1, wherein a first demolition container and a second demolition container may be attached or coupled together, via interaction of said recessed coupling portion of said first demolition container and said extending coupling portion of said second demolition container.

12. The demolition container system of claim 1, wherein said extending cap coupling portion comprises a protrusion configured to fit within at least a portion of said recessed coupling portion.

13. The demolition container system of claim 1, wherein a number of cap coupling tabs of said extending cap coupling portion corresponds to or is less than a number of coupling slots of said recessed coupling portion of said demolition container.

14. The demolition container system of claim 1, wherein said recess portion shoulder of each of said recess locking tabs is separated from said recess portion surface by a space allowing said cap coupling tabs of said extending cap coupling portion to be rotatable within said recess of said recessed coupling portion.

15. The demolition container system of claim 1, wherein, during attachment or coupling of said demolition container cap and said demolition container, said cap coupling tabs of said extending cap coupling portion are initially aligned with said coupling slots of said recessed coupling portion, said cap coupling tabs are urged through said respective coupling slots and said cap coupling tabs of said extending cap coupling portion of said demolition container cap are positioned within at least a portion of said recessed coupling portion of said demolition container, said demolition container cap is rotated, such that said cap coupling tabs of said extending cap coupling portion are positioned under at least a portion of said recess locking tabs of said recessed coupling portion.

16. The demolition container system of claim 1, wherein said demolition liner is a conical demolition liner, a linear demolition liner, a hemispherical demolition liner, or an Explosively Formed Projectile demolition liner.

17. A demolition container system, comprising:

a demolition container extending from a demolition container first end to a demolition container second end, wherein a demolition container aperture is formed through said demolition container, extending from said demolition container first end to said demolition container second end, wherein said demolition container aperture has a first inner diameter as said demolition container aperture extends from said demolition container first end, toward said demolition container second end, to a demolition container aperture shoulder, wherein said demolition container aperture has a second inner diameter as said demolition container aperture extends from said demolition container aperture shoulder to said demolition container second end, wherein an extending coupling portion is formed proximate or within a portion of said demolition container second end and a recessed coupling portion is formed proximate or within a portion of said demolition container first end, wherein said extending coupling portion extends from a coupling portion surface to said demolition container second end, wherein one or more coupling tabs extend, at spaced apart locations, from said extending coupling portion, and wherein a coupling tab shoulder is formed between a surface of each coupling tab and said extending coupling portion, wherein said recessed coupling portion is formed between a recess portion surface formed within said demolition container aperture and said demolition container first end, wherein said recessed coupling portion includes one or more recess locking tabs, wherein each recess locking tab extends from a sidewall of said recessed coupling portion, proximate said demolition container first end, and towards a middle of said demolition container aperture, and wherein a coupling slot is defined between each of said recess locking tabs, and wherein a plurality of recessed channels are formed in said side walls, extending from said demolition container second end to said recess portion surface;

a demolition container cap, wherein said demolition container cap includes a cap portion having a cap portion surface, wherein an extending cap coupling portion extends from a portion of said cap portion surface, wherein one or more cap coupling tabs extend from said extending cap coupling portion at spaced apart locations, wherein a cap coupling tab shoulder is formed between a surface of each cap coupling tab and said extending cap coupling portion, wherein at least one demolition container cap aperture is formed through said demolition container cap, wherein said demolition container cap aperture includes internal cap aperture threads, and wherein said demolition container and said demolition container cap are releasably attached or coupled to one another, via interaction of said recessed coupling portion of said demolition container and said extending cap coupling portion of said demolition container cap; and at least one demolition liner, wherein said at least one demolition liner is insertable into said demolition container aperture such that at least a portion of said at least one demolition liner contacts said demolition container aperture shoulder and interaction between at least a portion of said at least one demolition liner and a portion of said demolition container aperture shoulder maintains said at least one demolition liner within said demolition container aperture and a demolition container cavity is formed between said at least one demolition liner and at least a said recess portion surface of said recessed coupling portion.

18. The demolition container system of claim 17, wherein said demolition container aperture is defined by one or more side walls and wherein said plurality are formed in said side walls, extending from said demolition container second end to said recess portion surface.

19. A demolition container system, comprising:

a demolition container extending from a demolition container first end to a demolition container second end, wherein a demolition container aperture is formed through said demolition container, wherein said demolition container aperture extends from said demolition container first end, toward said demolition container second end, to a demolition container aperture shoulder, wherein said demolition container aperture extends from said demolition container aperture shoulder to said demolition container second end, wherein an extending coupling portion is formed proximate or within a portion of said demolition container second end and a recessed coupling portion is formed proximate or within a portion of said demolition container first end, wherein said extending coupling portion extends from a coupling portion surface to said demolition container second end, wherein one or more coupling tabs extend, at spaced apart locations, from said extending coupling portion, and wherein a coupling tab shoulder is formed between a surface of each coupling tab and said extending coupling portion, wherein said recessed coupling portion is formed between a recess portion surface formed within said demolition container aperture and said demolition container first end, wherein said recessed coupling portion includes one or more recess locking tabs, wherein each recess locking tab extends from a sidewall of said recessed coupling portion, proximate said demolition container first end, and towards a middle of said demolition container aperture, and wherein a coupling slot is defined between each of said recess locking tabs, and wherein a plurality of recessed channels are formed in said side walls, extending from said demolition container second end to said recess portion surface, wherein a demolition liner is insertable into said demolition container aperture such that at least a portion of said demolition liner contacts said demolition container aperture shoulder and interaction between at least a portion of said demolition liner and a portion of said demolition container aperture shoulder maintains said demolition liner within said demolition container aperture and a demolition container cavity is formed between said demolition liner and at least a recess portion surface of said recessed coupling portion; and a demolition container cap, wherein said demolition container cap includes a cap portion and an extending cap coupling portion extending from a portion of said cap portion, wherein one or more cap coupling tabs extend from said extending cap coupling portion at spaced apart locations, wherein a cap coupling tab shoulder is formed between a surface of each cap coupling tab and said extending cap coupling portion, wherein at least one demolition container cap aperture is formed through said demolition container cap, and wherein said demolition container and said demolition container cap are releasably attached or coupled to one another, via interaction of said recessed coupling portion of said demolition container and said extending cap coupling portion of said demolition container cap.

20. The demolition container system of claim 19, wherein said demolition container aperture is defined by one or more side walls and wherein said plurality of recessed channels are formed in said side walls, extending from said demolition container second end to said recess portion surface.

* * * * *